US012465106B2

(12) United States Patent
Arzoni et al.

(10) Patent No.: US 12,465,106 B2
(45) Date of Patent: Nov. 11, 2025

(54) PROTECTIVE HEADGEAR ARTICLES WITH PADDING

(71) Applicant: SYZMIK Sports, LLC, Timonium, MD (US)

(72) Inventors: Steve Arzoni, Lutherville-Timonium, MD (US); Christopher Gregg Perra, Kansas City, MO (US); Rodney Dennis Trafford, Boca Raton, FL (US); Albert Straus, Timonium, MD (US)

(73) Assignee: SYZMIK Sports, LLC, Timonium, MD (US)

( * ) Notice: Subject to any disclaimer, the term of this patent is extended or adjusted under 35 U.S.C. 154(b) by 0 days.

(21) Appl. No.: 18/131,863

(22) Filed: Apr. 6, 2023

(65) Prior Publication Data

US 2023/0309641 A1 Oct. 5, 2023

Related U.S. Application Data

(63) Continuation-in-part of application No. 17/361,643, filed on Jun. 29, 2021.

(60) Provisional application No. 63/126,235, filed on Dec. 16, 2020, provisional application No. 63/045,864, filed on Jun. 30, 2020.

(51) Int. Cl.

| | |
|---|---|
| ***A42B 3/12*** | (2006.01) |
| ***A41D 20/00*** | (2006.01) |
| ***A42B 3/06*** | (2006.01) |
| ***A63B 71/10*** | (2006.01) |

(52) U.S. Cl.

CPC ..... *A42B 3/127* (2013.01); *A41D 20/00* (2013.01); *A42B 3/06* (2013.01); *A63B 71/10* (2013.01)

(58) Field of Classification Search

CPC .... A41D 13/015; A41D 13/05; A41D 13/055; A41D 13/0581; A41D 13/0587; A41D 13/0593; A41D 20/00; A42B 1/08; A42B 3/00; A42B 3/069; A63B 71/10

See application file for complete search history.

(56) References Cited

U.S. PATENT DOCUMENTS

| | | | | |
|---|---|---|---|---|
| 4,646,367 | A * | 3/1987 | El Hassen | A42B 3/00 2/412 |
| 4,937,888 | A | 7/1990 | Straus | |
| 6,000,062 | A | 12/1999 | Trakh | |
| 6,381,760 | B1 * | 5/2002 | Lampe | A63B 71/10 2/418 |
| 8,056,150 | B2 | 11/2011 | Stokes et al. | |
| 9,226,533 | B2 * | 1/2016 | Turner | A41D 13/0506 |
| 9,392,831 | B2 * | 7/2016 | Storelli | A42B 3/069 |
| 9,398,779 | B2 * | 7/2016 | Turner | A63B 71/1225 |
| 9,505,203 | B2 * | 11/2016 | Turner | A41D 13/015 |
| 9,737,106 | B1 | 8/2017 | Cannon, Jr. | |
| 9,795,179 | B2 | 10/2017 | Lytle | |
| 10,080,394 | B2 * | 9/2018 | Johnston | A42B 1/08 |
| 10,383,386 | B2 * | 8/2019 | Abraham | A42B 3/125 |
| D956,359 | S * | 6/2022 | McPhail | D29/102 |

(Continued)

*Primary Examiner* — F Griffin Hall
(74) *Attorney, Agent, or Firm* — Offit Kurman, P.A.; Gregory A. Grissett

(57) ABSTRACT

Helmet assembly for light impacts. The assembly includes a soft helmet with recesses on the helmet inner surface. Detachable pads are configured to fit in the recesses, to provide soft inner protection for the wearer. Detachable shims are configured to fit in between the pads and recesses in order to properly fit the helmet to the wearer.

24 Claims, 34 Drawing Sheets

(56) References Cited

U.S. PATENT DOCUMENTS

2021/0085011 A1* 3/2021 Santiago ..... A42B 3/125
2021/0360992 A1* 11/2021 Hamburger ..... A41D 13/015

* cited by examiner

Front Pad

Rear Pad

Left

PROTECTIVE HEADGEAR ARTICLES WITH PADDING

CROSS-REFERENCE TO RELATED APPLICATIONS

This application is continuation-in-part of U.S. application Ser. No. 17/361,643, filed Jun. 29, 2021, which claims priority to and the benefit of U.S. Provisional Application No. 63/045,864, filed Jun. 30, 2020, and U.S. Provisional Application No. 63/126,235, filed Dec. 16, 2020, the entire contents of each application are incorporated by reference into the present disclosure for all purposes.

FIELD OF INVENTION

The present discloser relates protective headgear articles. More particularly, the present disclosure relates to protective helmets, headbands, and helmet shells with padding.

BACKGROUND

Adding soft padding to the outside of a helmet shell may mitigate the damage caused by a head impact. For example, U.S. Pat. No. 4,937,888 by Straus discloses a helmet covered in soft foam having a resilient outer skin. Other innovations include U.S. Pat. No. 9,737,106 by Cannon, which discloses cushions strapped across the outside of a football helmet, and U.S. Pat. No. 9,795,179 by Lytle which discloses a helmet having a soft cover with at least two vents that provides a flow of air through the helmet.

While the above prior art may be suitable for its intended purposes, a less bulky helmet with soft outer padding is needed for sports where head contact is only incidental, for example, lacrosse, skate boarding, or snow sports. Where head-on collisions are infrequent, external padding may only be required in on front, side, or back sections of the helmet. In addition, the above prior art includes multiple components that require separate manufacturing processes and complex assembly, such that altering one piece requires altering other components.

Innovations for adjustable internal padding include U.S. Pat. No. 8,056,150 by Stokes, which discloses a clutch mechanism to adjust and set the inner strap portion of a helmet around the wearer's head. U.S. Pat. No. 6,000,062 by Trakh discloses a soccer headband with detachable ends fastened by hook-and-loop material.

SUMMARY

An embodiment of the present disclosure includes a protective headgear, such as a helmet and a headband.

The protective helmet comprises a shell configured to fit a human head. The shell includes pockets on the front, sides, and back of the shell. The helmet also comprises external foam pads that are configured to fit into the helmet pockets such that the front, sides, and back of the wearer's head are protected by external foam padding.

Another embodiment of the present disclosure is a helmet comprising of a top section and a bottom section. The top section of the helmet is comprised of a hard rigid material, such as hard plastic. The bottom section of the helmet is comprised of a soft resilient material, such as foam. The top and bottom sections of the helmets are permanently affixed to one another, via mechanical and/or chemical bonding.

Another embodiment of the present disclosure is a helmet comprising a top section and a bottom section. The top section of the helmet is comprised of a soft resilient material, such as foam. The bottom section of the helmet is comprised of a soft resilient material, such as foam. The top and bottom sections of the helmet are permanently affixed to one another during the forming process.

The helmets as described herein may include internal comfort pads configured to fit inside the shell and provide extra protection to the front, sides, and back of the wearer's head.

According to another embodiment of the present disclosure, a padding band for the inside of a helmet. The band includes individual pads having respective flat backing surface. The backings are joined in a series by elastic strips. In an embodiment, the band has four pads, one on each of the front, rear, right, and left sides of the band.

The distal ends of the band include attachment mechanisms such that the band may be formed into a circle. In an embodiment, the attachment mechanisms are hook-and-loop closures. The attachment mechanism may be affixed in more than one relative position such that the overall circumference of the formed circle band is adjustable to the size of the wearer's head.

The flat backing surface includes an attachment mechanism configured to attach to counterparts located on the inner surface of the helmet. In an embodiment, the attachment mechanism is a strip of loops in a hook-and-loop system. The inner surface of the helmet includes patches of hooks configured to affix to the strip of loops. The loops may be on the helmet and the hooks may be on the band, as needed. The patches are located at the front, back, left, and right of the helmet inner surface.

In an embodiment, the band is used without a helmet. In such an embodiment, the flat backing surfaces are flush against the user's head and the individual pads face outward when the headband is worn.

In another embodiment, the band is a closed shape with no distal ends. The band includes an inner loop with an inner surface and an outer surface. The band includes four discrete outward-facing pads are affixed to the outer surface of the loop.

In another embodiment, a lower section of the helmet is made of soft and resilient material. The inner surface of the helmet includes recesses configured to receive inner padding. Shims in the shape of the recess can be added to properly fit the helmet to the wearer.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Figure 1:
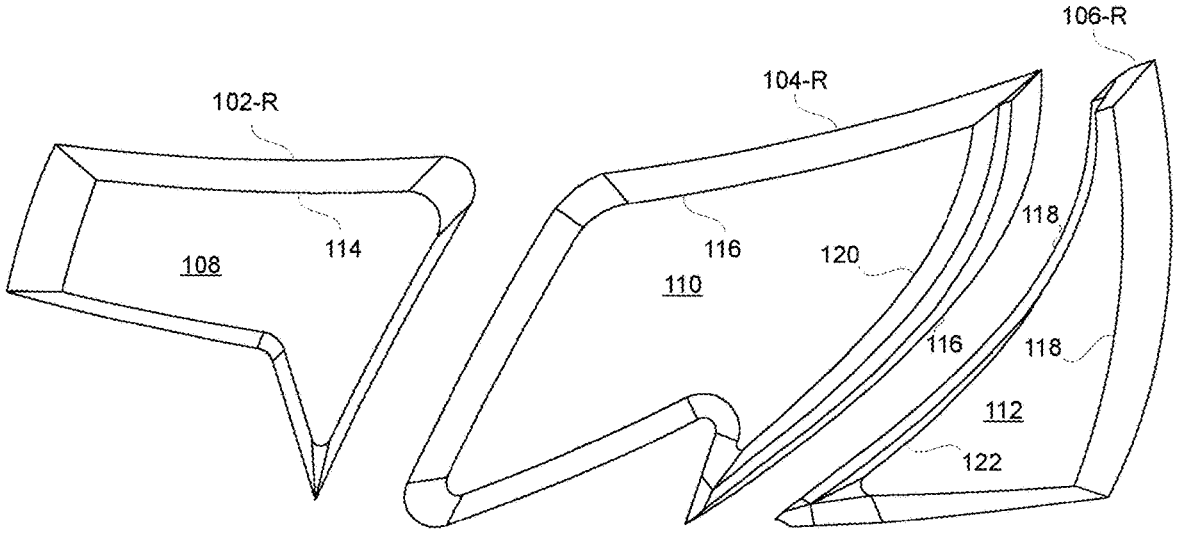
FIG. 1 is an inside view of outside padding components for a helmet according to an embodiment of the present disclosure.

Embodiments of the present disclosure include protective headgear articles. A protective headgear article may be a protective helmet 400, 900, 4702 and a protective headbands 2200, 3200, and 6000.

An assembly for a protective helmet 400 is disclosed. Another embodiment and variation is disclosed as helmet 900. Individual symmetrical components may include left and right side suffix designations, for example left and right front pads 102-R, 102-L, or left and right side pockets 306-L, 306-R. When general properties of symmetrical components are being discussed, the suffix is sometimes removed, for example, front pads 102 or side pockets 306. Location terms such as left, right, top, bottom, front, and rear are in reference to the relative orientation of a helmet wearer who is standing up straight, and are not intended as absolute.

The embodiments 400, 900 disclosed herein do not represent all of the protective headgear components that a wearer might wear during use. For example, inner pads, crown pads, resilient inner crown straps, chin straps, face shields, and other protective headgear may be affixed to, or used in conjunction with, the disclosed embodiments.

Figure 2:
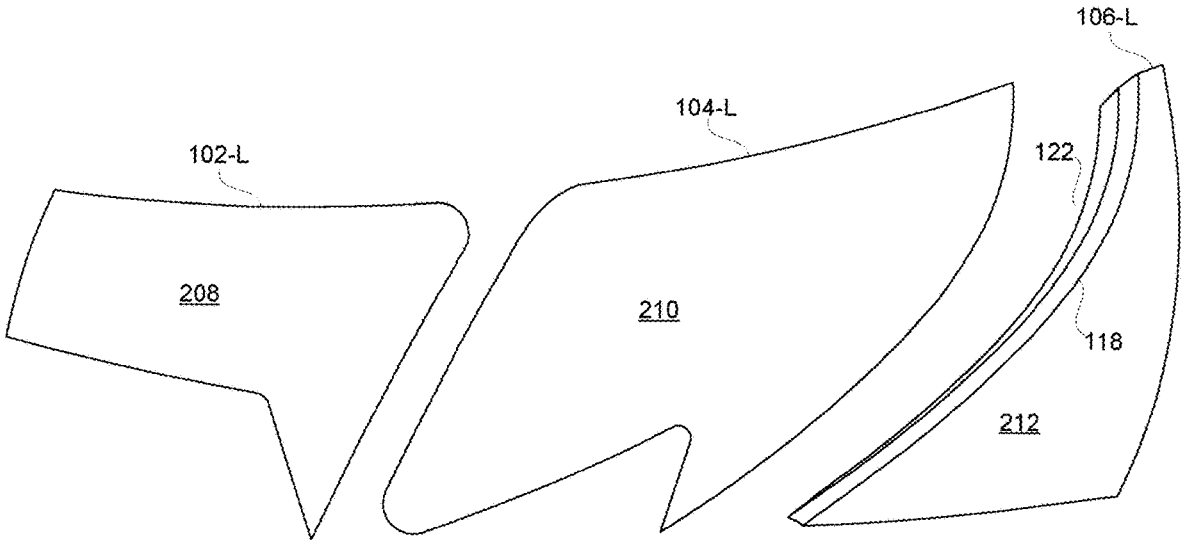
FIG. 2 is an outside view of outside padding components for the first embodiment of the present disclosure.

FIG. 1 illustrates an inner view of three pieces of right side padding 102-R, 104-R, 106-R, and FIG. 2 illustrates an outer view of three pieces of corresponding left side padding 102-L, 104-L, 106-L. The left side padding 102-L, 104-L, 106-L is identical in size to, and has mirror symmetry shape to, the right side padding 102-R, 104-R, 106-R.

The padding inner surfaces 108, 110, 112 are smooth and concave. The padding outer surfaces 202, 204, 206 are smooth and convex. The padding sides 114, 116, 118 are beveled such that a pad's inner surface 108, 110, 112 has a smaller surface area than that pad's outer surface 202, 204, 206.

The side pads 104 include convex ridges 120 that extend from the top to the bottom of the rear-facing side of the pads 104. The rear pads 106 include concave ridges 122 that extend from the top to the bottom of the front facing side of the pads 106.

The padding 102, 104, 106 is soft and resilient such that each pad 102, 104, 106 returns to its original shape after an impact. In one embodiment, the padding 102, 104, 106 is made of reaction-molded polyurethane flexible foam. During the molding process, the foam forms a smooth outer skin process that is flexible but resistant to tearing. Padding 102, 104, 106 resilience and density depends on factors including the likelihood of area of impact upon a particular player and the type of sport that that the player is engaged in.

Figure 3:
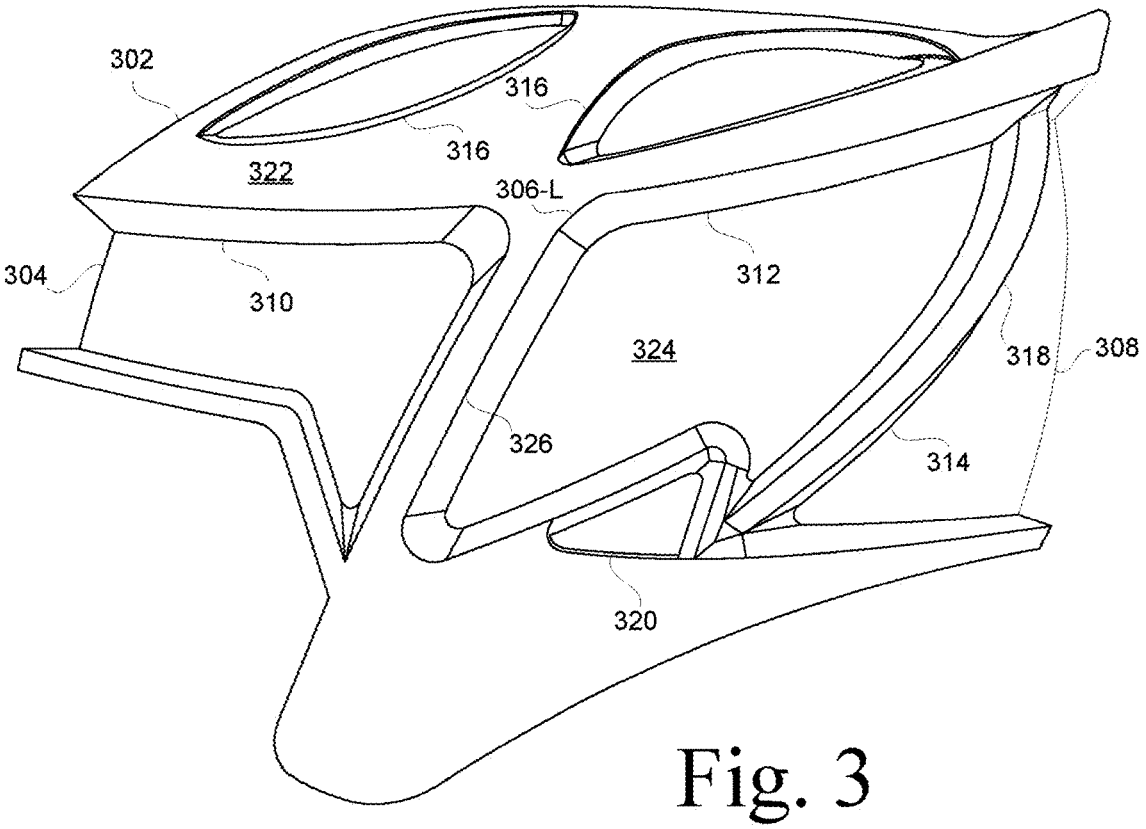
FIG. 3 is a side view of a shell component of the helmet used with padding components shown in FIGS. 1 and 2.

FIG. 3 illustrates a shell 302 without padding 102, 104, 106. The shell 302 is made of a material that is hard, rigid, and lightweight, for example, medium-density polyethylene, acrylonitrile butadiene styrene, or polyurethane. In one embodiment, the shell 302 is made of a single material and manufactured as a single molded piece.

Figure 10:
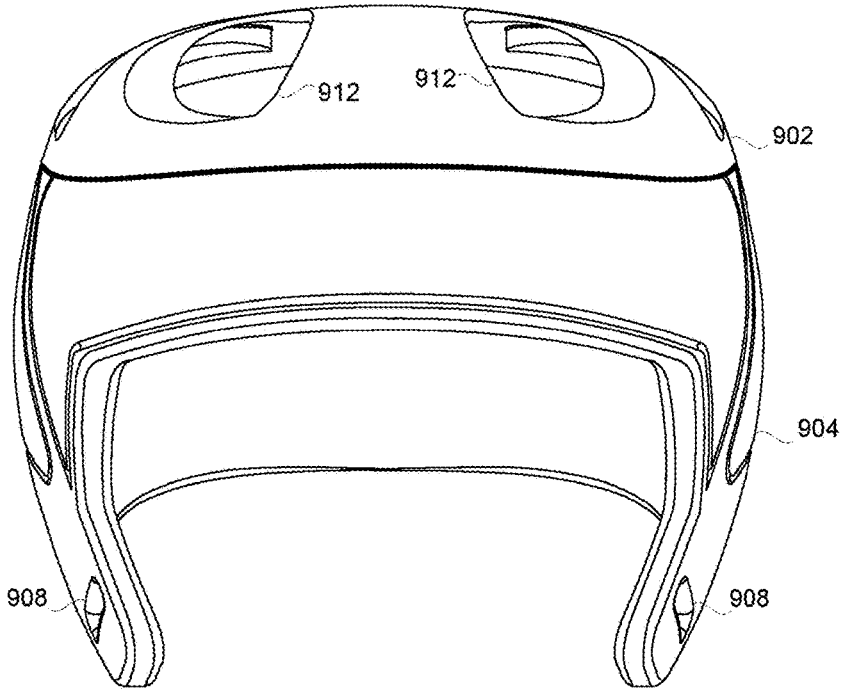
FIG. 10 is a front view of the helmet shown in FIG. 9.
Figure 11:
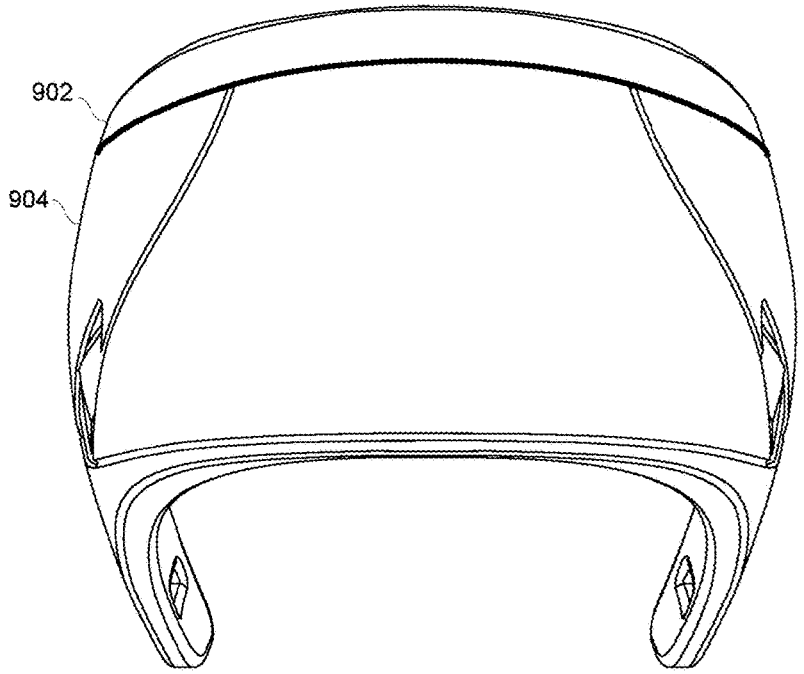
FIG. 11 is a rear view of the helmet shown in FIG. 9.
Figure 12:
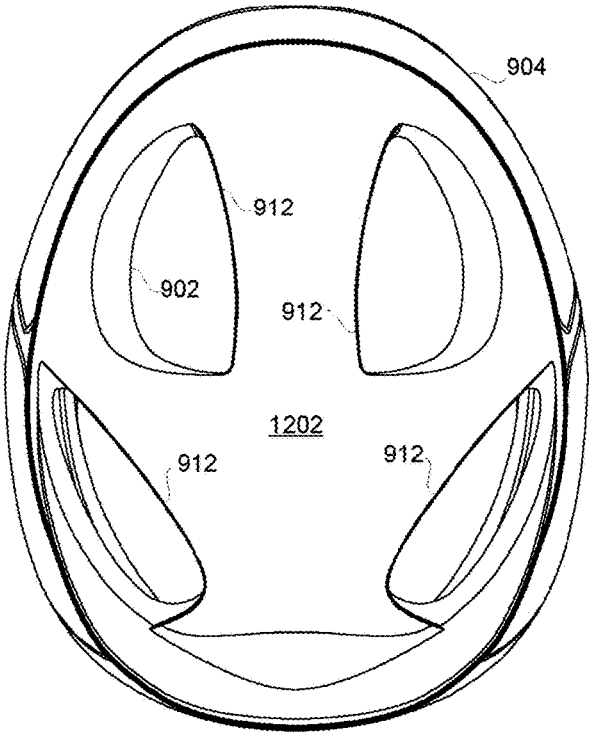
FIG. 12 is a top view of the helmet shown in FIG. 9.
Figure 13:
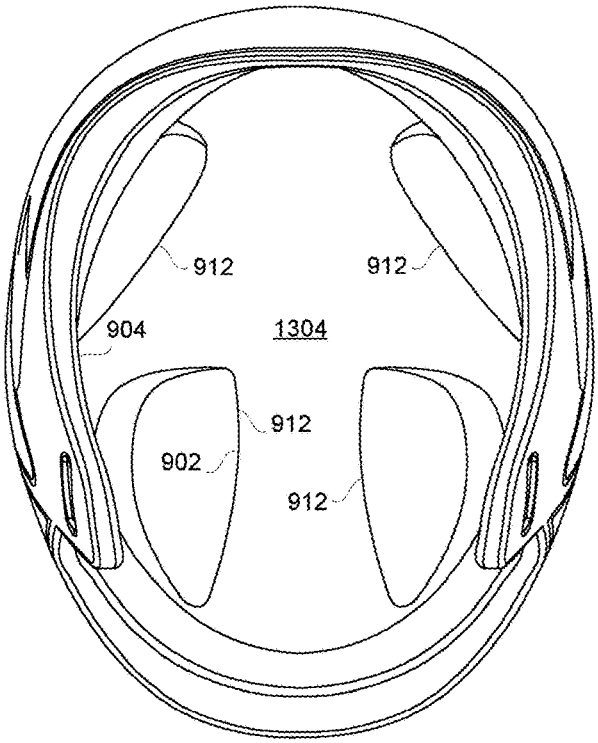
FIG. 13 is a bottom view of the helmet shown in FIG. 9.
Figure 14:
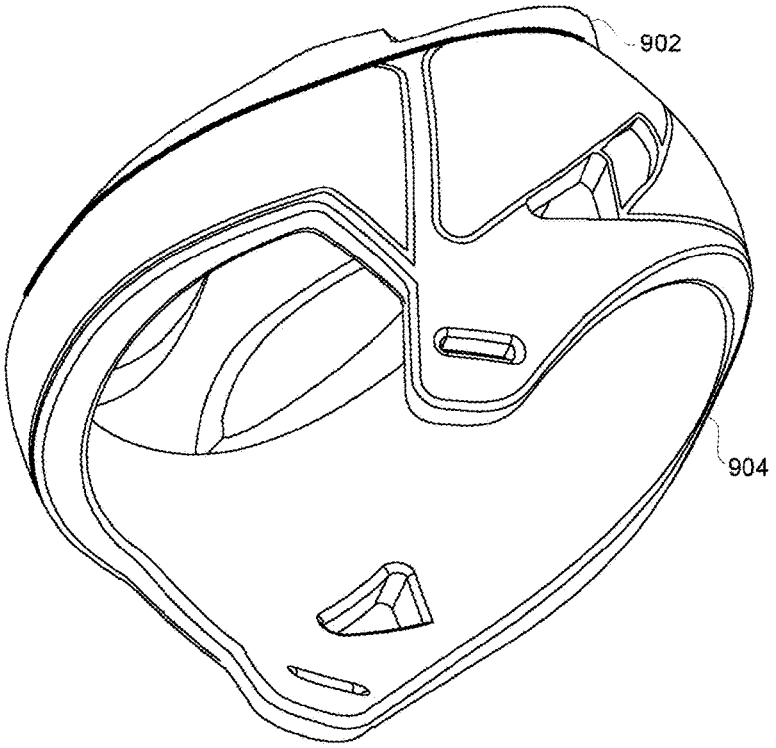
FIG. 14 is a bottom left isometric view of the helmet shown in FIG. 9.
Figure 15:
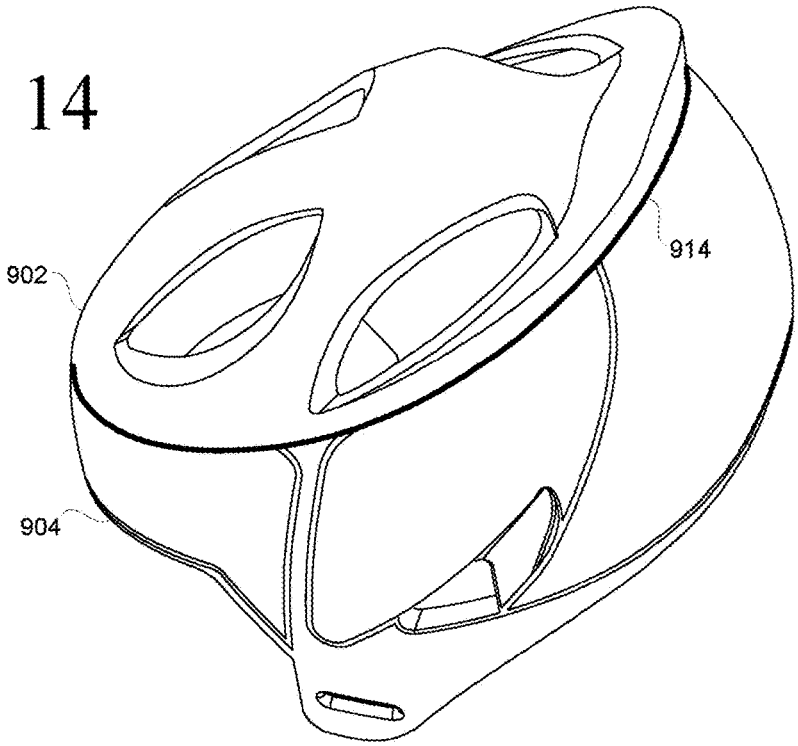
FIG. 15 is an upper left isometric view of the helmet shown in FIG. 9.

In one embodiment, the shell 302 is configured for lacrosse and includes an extended visor. In another embodiment, the shell 302 is configured for snowboarding and rounded on top. In another embodiment, the shell 302 includes attachments for a facemask. In another embodiment, the shell 302 includes chinstrap apertures, as shown at 908 in FIG. 10. Other modifications to the shell 302 for the requirements of various sports can be made by means obvious to those with ordinary skill in the art.

The shell top 302 includes multiple vents 316 that allow for air circulation to keep the wearer cool during use. The vents extend from the shell outer surface 322 to the shell inner surface 504. An additional vent 320 is below each side pocket 306. The vents 320 are configured to superpose at least partially with the wearer's ears to enable hearing. The vents 320 extend from the shell outer surface 322 to the shell inner surface 504.

The floors 324 of the side pockets 306 are smooth and convex. The side pockets 306 include sides 312 that slope away and outward from the floor surfaces 324 of the pockets 306. Ridges 318 separate the side pockets 306 from the rear pocket 308. Ridges 326 also separate the side pockets 306 from the front pocket 304.

Figure 4:
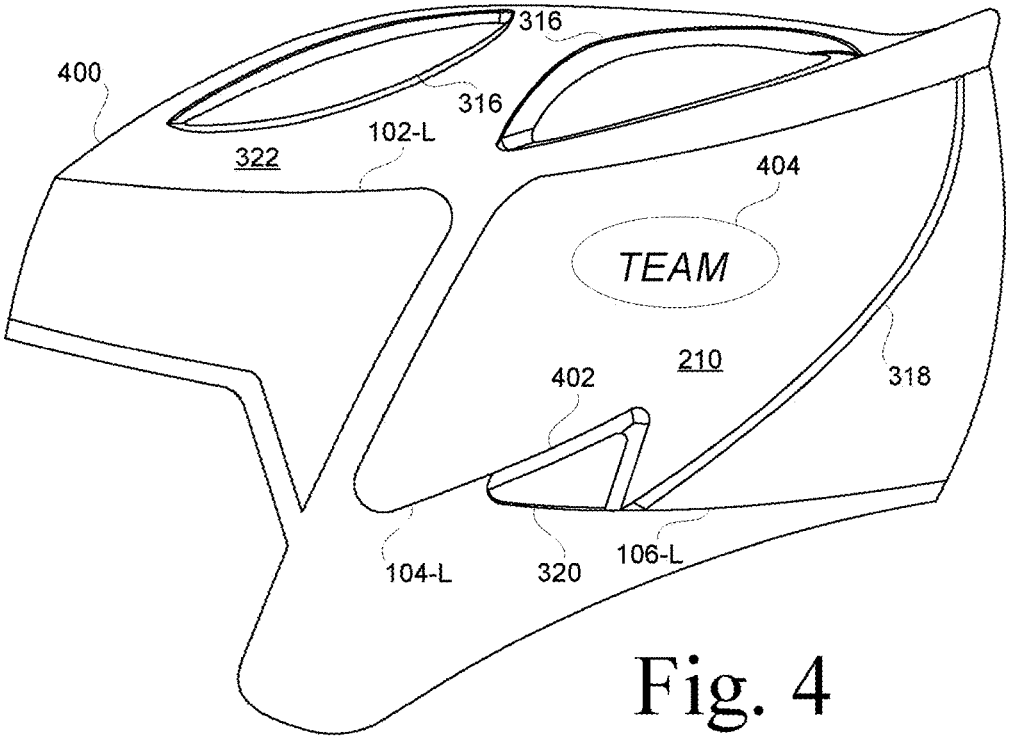
FIG. 4 is a side view of a helmet according to an embodiment of the present disclosure.

FIG. 4 illustrates the helmet 400 with the padding 102, 104, 106 inserted into the pockets 304, 306, 308. In one embodiment, the padding 102, 104, 106 is permanently affixed to the shell 302 via chemical bonding.

In other embodiments, the padding is affixed to the shell 302 and removed from the shell 302 via a paired hook and loop system, a light adhesive, paired magnets, or other attachment systems familiar to those with ordinary skill in the art. In one embodiment, the padding 102, 104, 106 is interchangeable such that pad coloring, or raised or embossed logos 404 is added to a padding external surface 210 without needing to change an entire helmet 400 or padding set 102, 104, 106. In one embodiment, a single shell 302 could include two full sets of different colored padding; for example, for home games and away games.

The side pad outer surfaces 210 are flush, level, and even with the shell surface 322 that is immediately adjacent. The side pads inner surfaces 110 and walls 116 are complementary in size and shape to the respective side pocket floor surfaces 324 and walls 312. The side pads 104 fill the side pockets 306, such that the entirety of the side pad inner surfaces 110 is contiguous with the respective floor surfaces 324 of the side pockets 306, and the entirety of the side pad walls 116 are contiguous with the side pocket walls 312.

Figure 5:
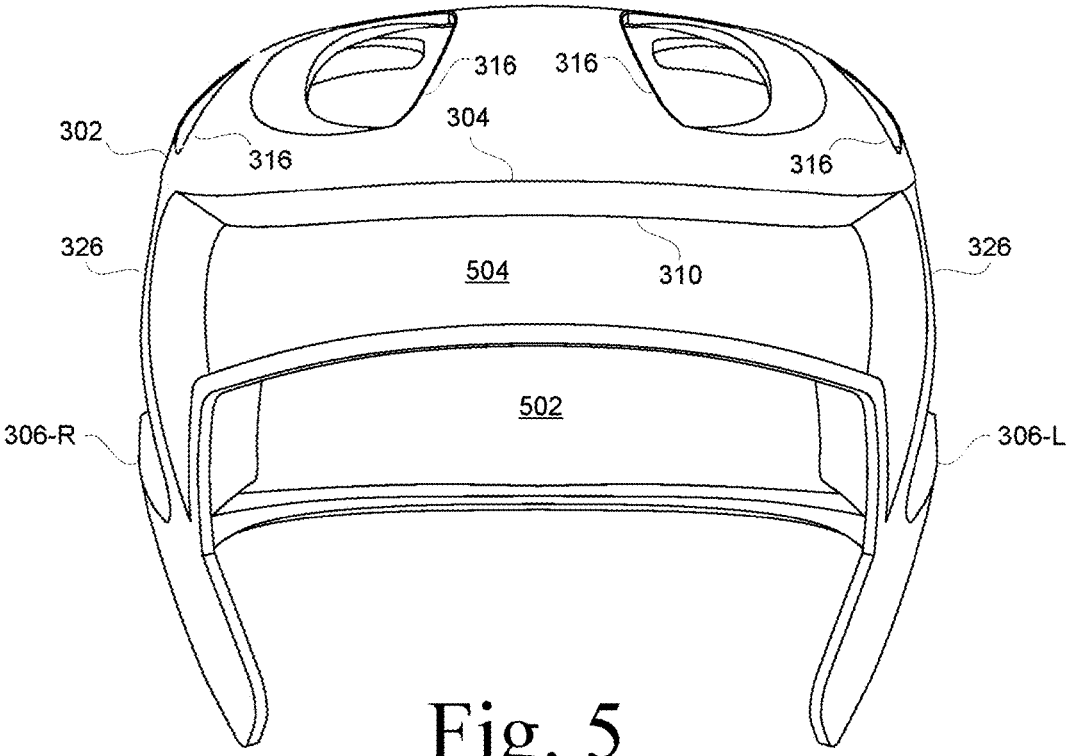
FIG. 5 is a front view of the shell component helmet shown in FIG. 4.

FIG. 5 illustrates the front of the shell 302 without padding. The front pocket 304 extends across the front of the shell 302 in front of the wearer's forehead. As seen in FIGS. 3 and 5, the walls 310 of the front pocket are at obtuse angles to the floor surface 504 of the front pocket 304, in order to allow for easy insertion and removal of the front pads 102. The floor surface 504 of the front pocket is smooth and convex.

Figure 6:
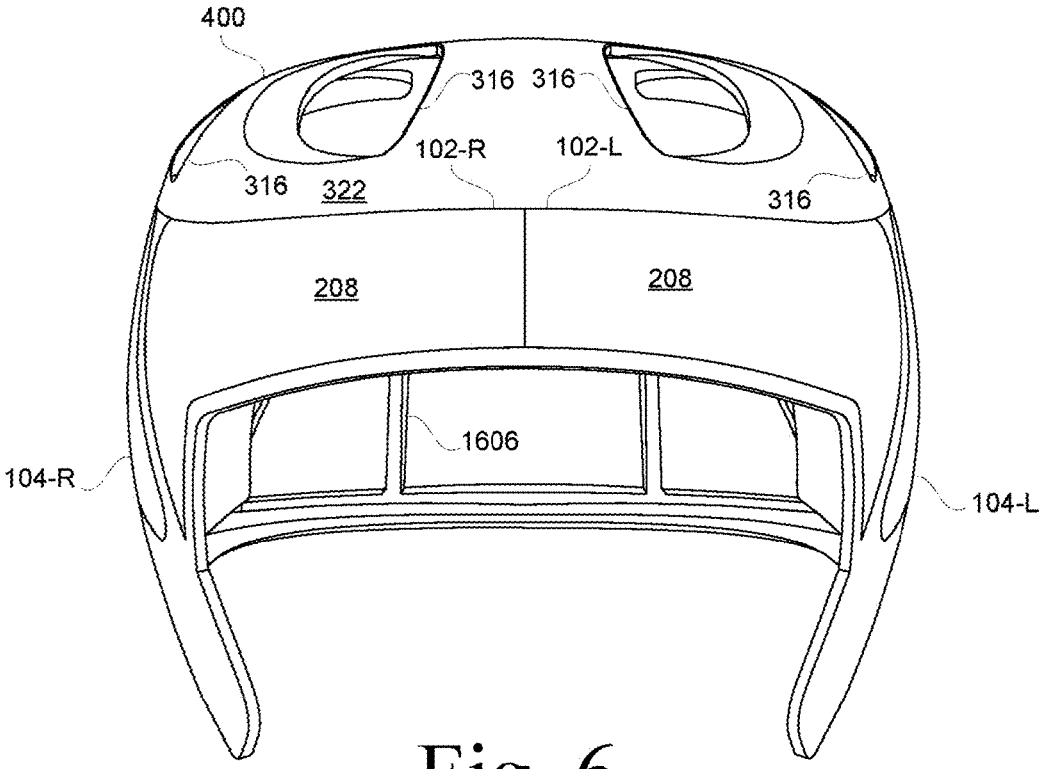
FIG. 6 is a front view of the shell component of the helmet shown in FIG. 4.

FIG. 6 illustrates the helmet 400 with the front pads 102-L, 102-R inserted into the front pocket 304. The pads 102 are shaped to collectively fill the front pocket 304. The pad outer surfaces 208 are flush, level, and even with the outer surface 322 of the shell. The pads 102-L, 102-R are contiguous at the front centerline of the helmet 400.

Figure 7:
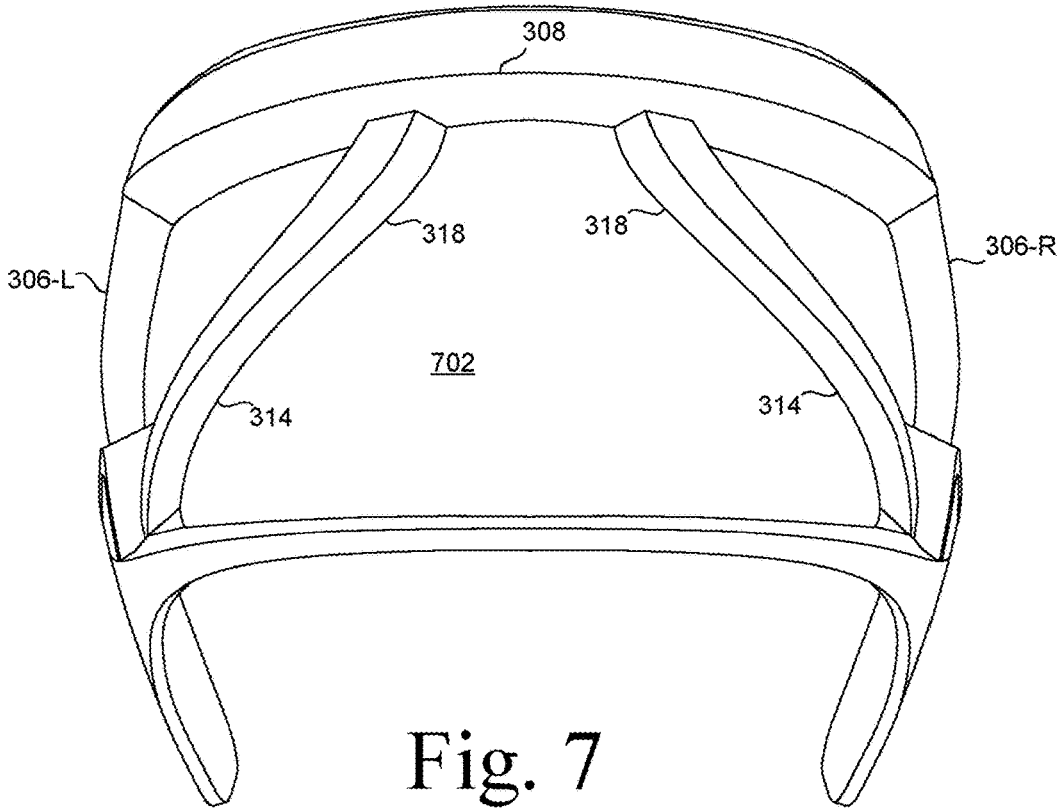
FIG. 7 is a rear view of the shell component of the helmet shown in FIG. 4.

FIG. 7 illustrates the rear of the shell 302 without padding. The rear pocket 308 includes a floor surface 702 that is smooth and convex. The walls 314 of the rear pocket are at obtuse angles to the floor surface 702.

Figure 8:
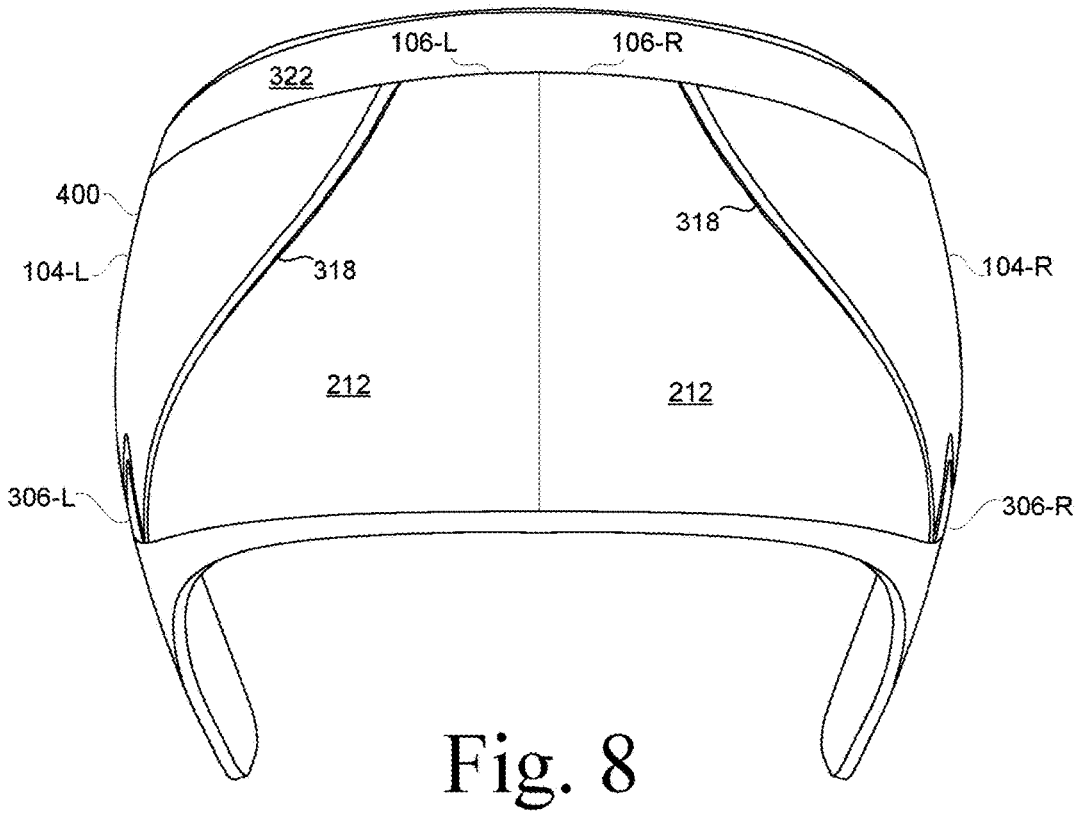
FIG. 8 is a rear view of the shell component of the helmet shown in FIG. 4.
Figure 9:
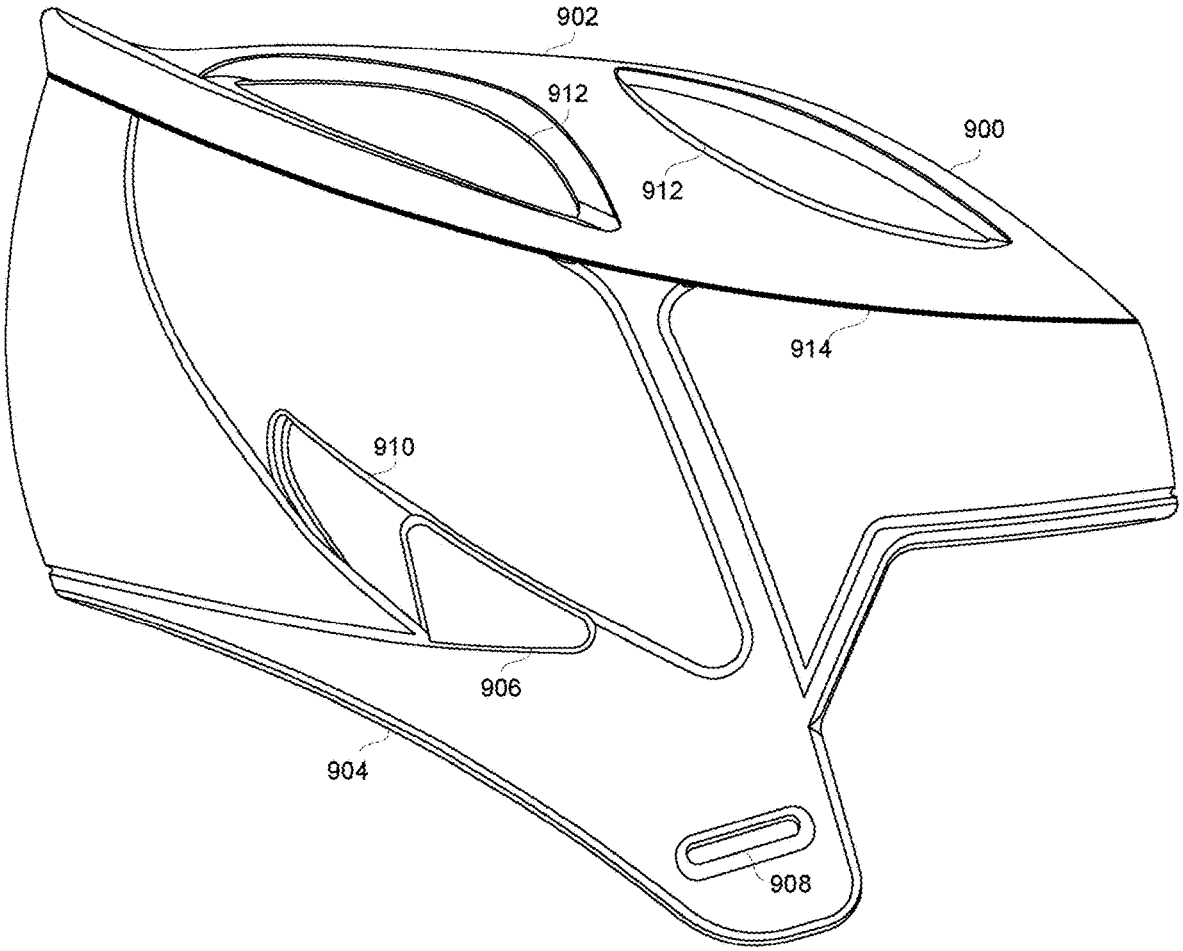
FIG. 9 is a side view of a helmet according to another embodiment of the present disclosure.

FIG. 8 illustrates the helmet 400 with the rear pads 106-L, 106-R inserted. The rear pad outer surfaces 212 are flush, level, and even with the helmet shell outer surface 322. The pads 106 share a contiguous border along the rear centerline of the helmet 400.

The simplicity with which the padding 102, 104, 106 is affixed to the shell 302 allows for easy modification of the material properties of the padding 102, 104, 106. In one embodiment, the padding 102, 104, 106 is thicker and protrudes beyond the outer surface 322 of the shell.

In another embodiment, a pad 104 is smaller than its respective pocket 306. The pad 104 is coupled to an elastomer, configured to slide along the floor surface 234 of the pocket upon impact, and bias back to a rest position, similar to the technology disclosed in U.S. Pat. No. 10,226,094 by Straus.

In another embodiment, the helmet 400 includes impact sensors that that detect the strength and frequency of external impacts upon the helmet 400 during use, and transmit that data to an external computer. Pads 102, 104, 106 of varying resilience, size, and hardness are switched out based upon the data gained from the sensors.

FIGS. 9, 10, 11, 12, 13, 14 and 15 illustrate a helmet embodiment 900 comprising a top section 902 and a bottom section 904. The top section 902 is made of a material that is hard, light, and rigid, for example, or example, medium-density polyethylene, acrylonitrile butadiene styrene, or polyurethane. The top section 902 includes vents 912 that extend from the top section outer surface 1202 to the top section inner surface 1304.

The top section 902 is affixed to the bottom section 904 at 914, with chemical bonding. The bottom section 904 is soft, resilient, and very flexible. In one embodiment, the bottom section 904 is made of reaction-molded polyurethane flexible foam. During the molding process, the foam forms a smooth outer skin process that is flexible but resistant to tearing.

In one embodiment, the bottom section 904 is molded from a single piece during the manufacturing process. In one embodiment, the bottom section 904 is molded as a single piece in a split cavity mold drawing to the right and left sides.

The bottom section 904 includes apertures 908 configured to receive a chinstrap. Due to the flexible nature of the bottom section, tightening a chinstrap will cause the front part of the bottom section 904 to mold to the wearer's face, thereby making the helmet 900 fit more securely.

In another embodiment, the top section 902 and bottom section 904 are made of the same material that is soft, resilient, and very flexible, such as reaction-molded polyurethane flexible foam. The top section 902 is manufactured as a single piece. The bottom section 904 is created by pouring the heated material into a mold that already contains the finished top section 902.

Figure 16:
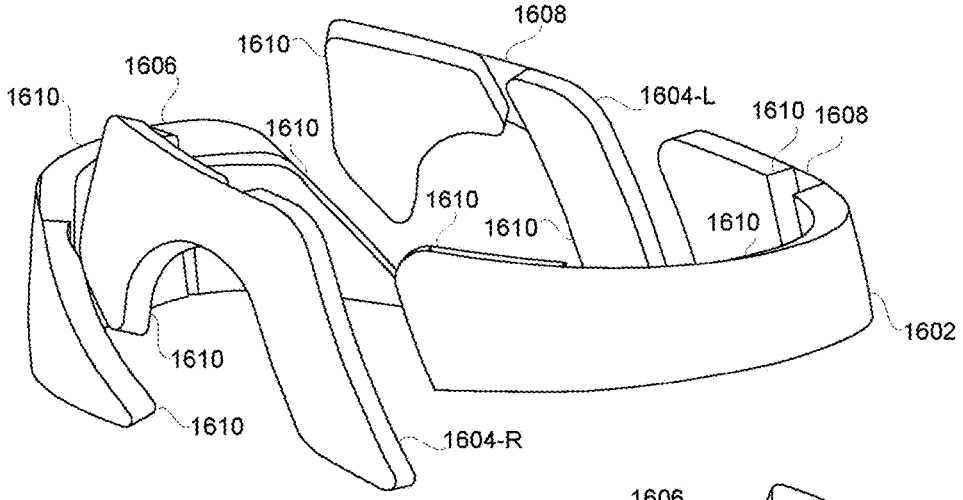
FIG. 16 is an isometric upper right view of internal padding used for the helmets shown in FIG. 4 and FIG. 9.
Figure 17:
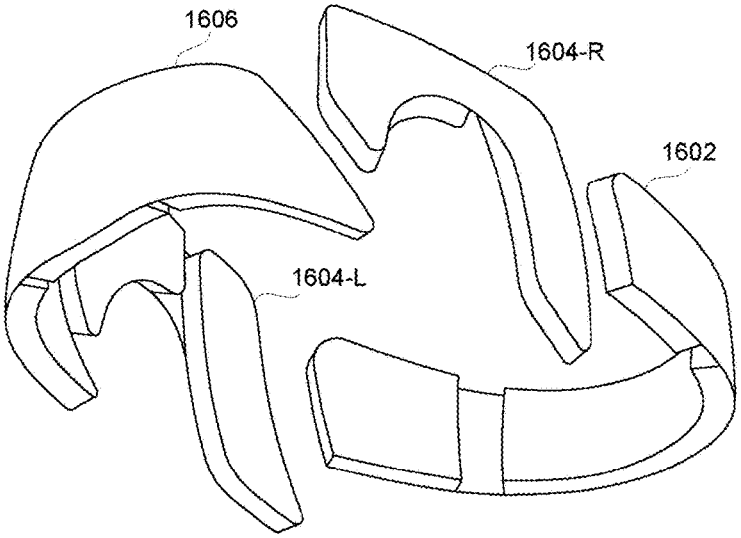
FIG. 17 is an isometric bottom right view of internal padding shown in FIG. 16.
Figure 18:
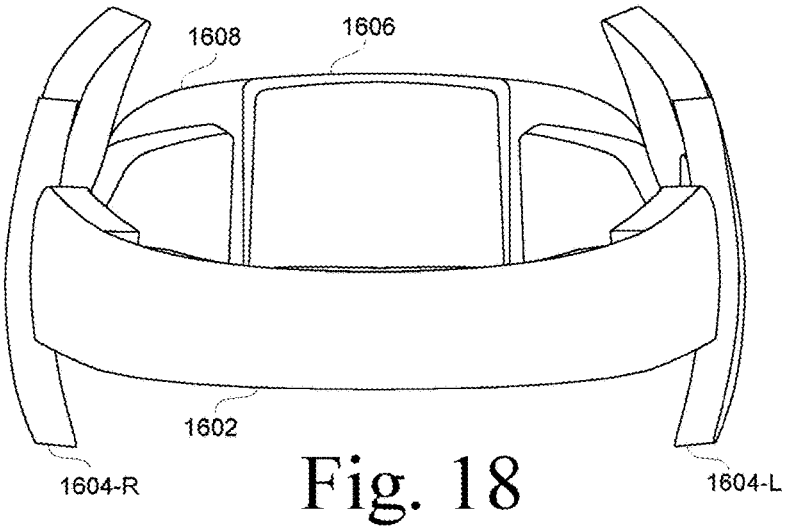
FIG. 18 is a front view of internal padding shown in FIG. 16.
Figure 19:
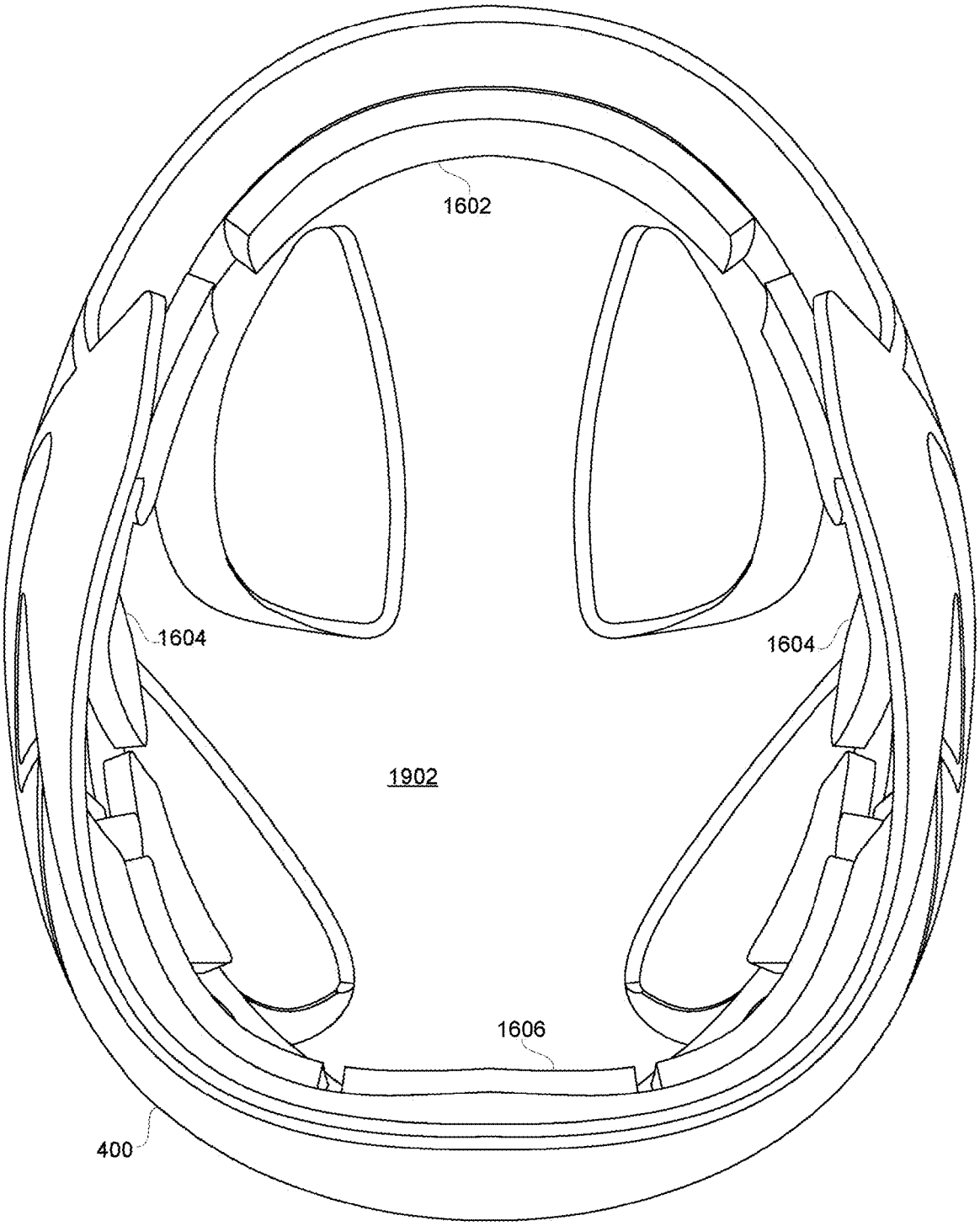
FIG. 19 is a bottom view of the helmet shown in FIG. 4 that includes the internal padding shown in FIG. 16.

FIGS. 16, 17, and 18 illustrate inner padding sets 1606, 1604-R, 1604-L, 1602, and FIG. 19 illustrates the inner padding sets 1602, 1604, 1606 inserted into an embodiment 400. The inner padding is configured to fit inside both illustrated embodiments 400, 900.

The individual pads 1610 have both compressive and shear elasticity and resilience. In one embodiment, the inner padding 1602, 1604, 1606 is comprised of parallel fabric layers having flexible nylon needles. In another embodiment, the inner padding 1602, 1604, 1606 is comprised of polyurethane foam.

Individual pad units 1610 are connected by affixed bands 1608. In one embodiment, the bands 1608 are made of an elastomer, thereby allowing the individual connected pads 1610 to shift relative to one another.

The side pads sets 1608 are configured to fit over a wearer's ear. The front pad set 1602 is configured to fit across a wearer's forehead. The rear pad set 1606 is configured to fit across the back of the wearer's head.

In one embodiment, the pad sets 1602, 1604, 1606 are fastened to the inner surface 1902 of the shell 302 via a paired chemical bonding. In other embodiments, the pad sets 1602, 1604, 1606 are detachably affixed via a hook and loop system, a light adhesive, paired magnets, or other attachment systems familiar to those with ordinary skill in the art.

In one embodiment the inner surface 1902 has an attachment mechanism, for example a loop portion of a hook-and-loop system.

Figure 20:
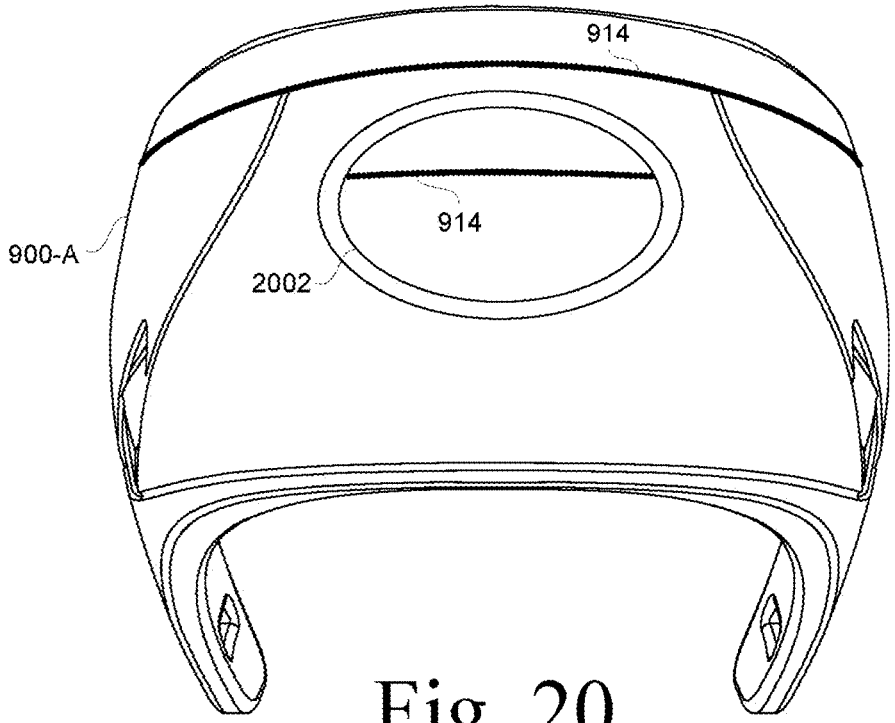
FIG. 20 is a rear view of a helmet article according to an embodiment of the present disclosure.
Figure 21:
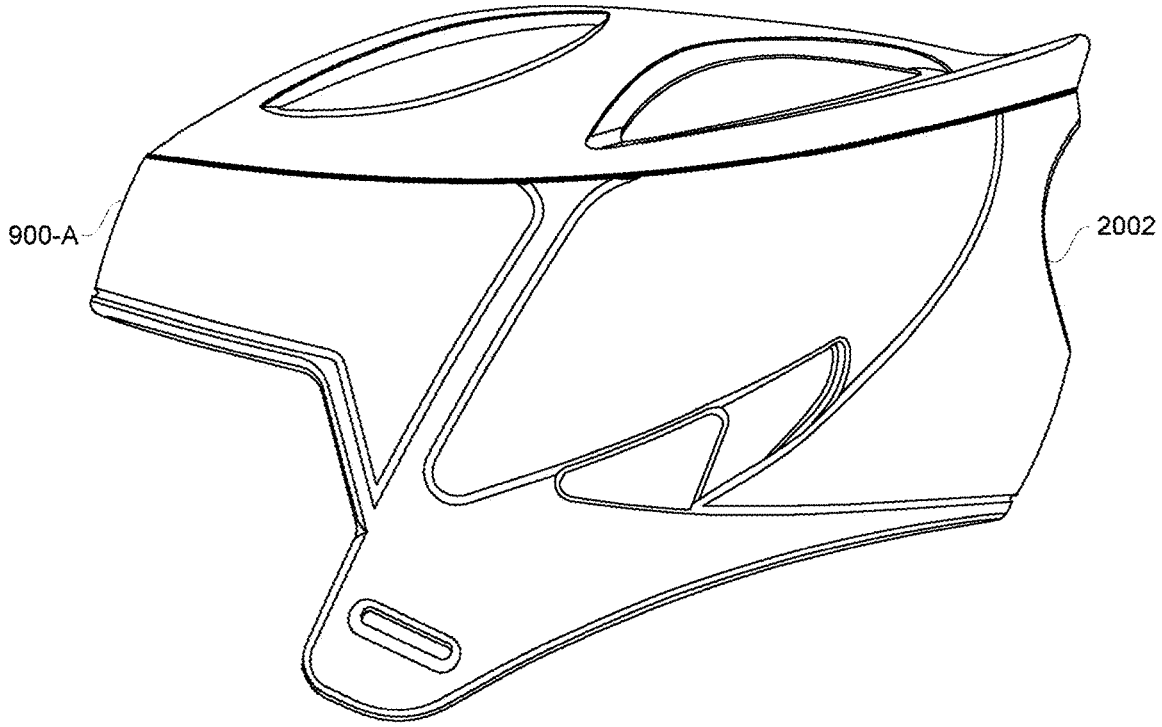
FIG. 21 is a side view of the helmet shown in FIG. 20.

FIGS. 20 and 21 illustrates an embodiment 900-A with an aperture 2002 in the rear of the helmet. The aperture 2002 is configured to fit a wearer's ponytail through the rear of the helmet 900-A.

The embodiments 400, 900 disclosed herein are intended as general conceptual templates and not restricted to a particular shape, design, or pocket setting. For example, one embodiment includes front and side pockets 310, 306 and no back pocket 308. Another embodiment integrates the front and side pockets 310, 306 as a single piece. In another embodiment, the shell 400 and padding 102, 104, 106 configurations are specialized to protect a female wearer based upon differing skull shapes between men and women.

A headband 2200 for protecting a wearer's head is disclosed. Individual elements may include suffix designations, for example front, back, right, and left pads are designated as 2226-F, 2226-B, 2226-R, and 2226-L respectively. When general properties of elements are being discussed, the suffix is sometimes removed, for example when pads generally are designated as 2226.

Figure 22:
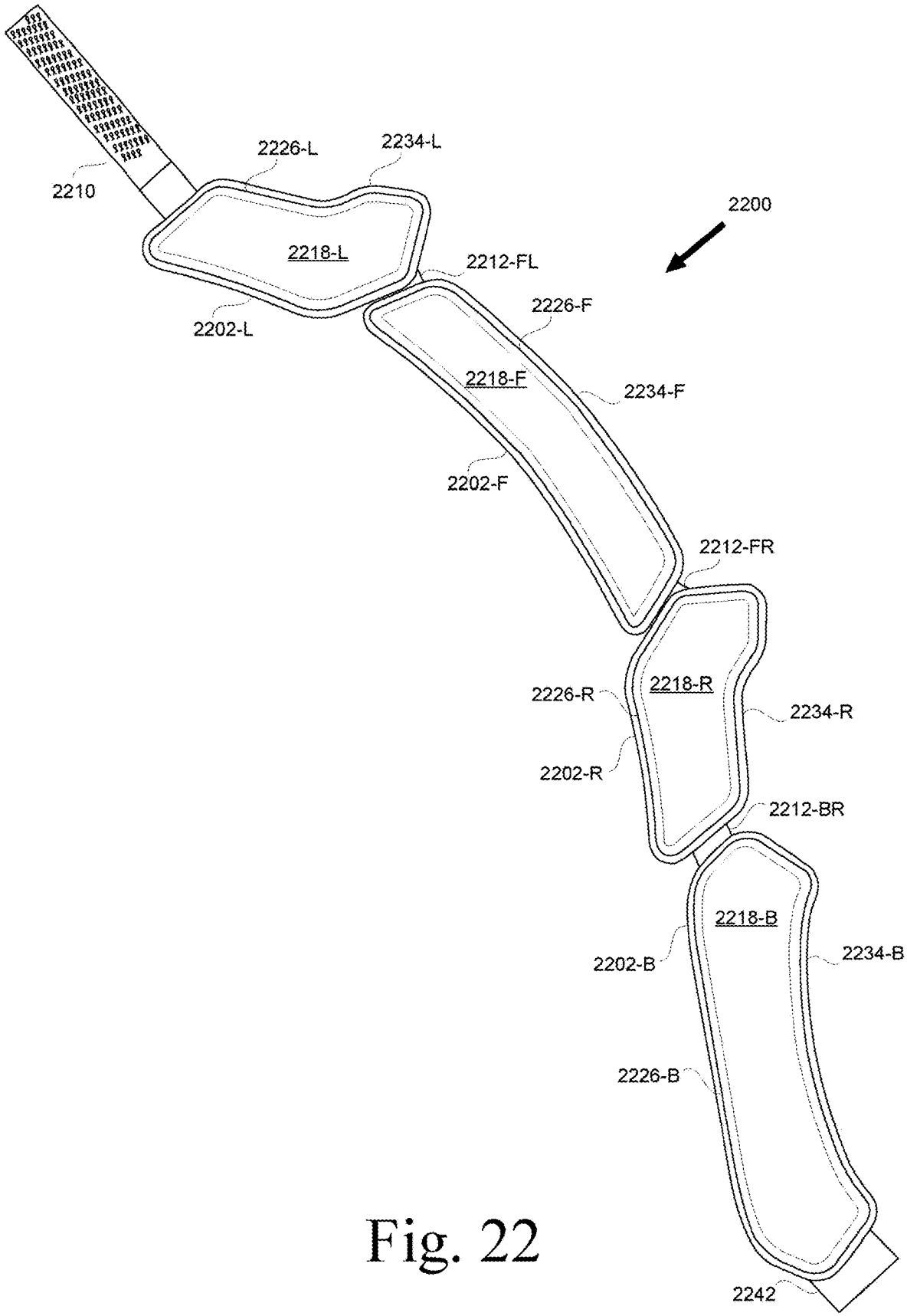
FIG. 22 is a front view of a band according to an embodiment of the present disclosure.

FIG. 22 illustrates the front of the band 2200, which is formed by individual components 2202-L, 2202-R, 2202-R, and 2202-B joined in a single series by connectors 2212-FL, 2212-FR, and 2212-BR.

Each component 2202 includes a respective pad 2226-L, 2226-F, 2226-R, and 2226-B. The pads 2226 are soft, flexible, resilient, and resistant to tearing. In one embodiment, the pads 2226, including the outer surfaces 2218-L, 2218-F, 2218-R, and 2218-B, are made of stacked layers of flocked energy absorbing material (FEAM), a version of which is disclosed in U.S. Pat. No. 9,788,589 by Lewis et al.

In another embodiment, the pads 2226 are made of reaction-molded polyurethane flexible foam. During the molding process, the foam forms smooth outer skin 2218 that is flexible but resistant to tearing. Resilience and density of the padding 2226 depends on factors including the likelihood of area of impact upon a particular player and the type of sport that the player is engaged in.

Each pad 2226 is contiguous with, and surrounded by, a respective flange 2234-L, 2234-F, 2234-R, and 2234-B. In one embodiment, the flanges 2234 are made of the same material as the outer surfaces 2218 of the pads 2226. In one embodiment, the flanges 2234 are made of FEAM.

Two distal straps 2210, 2242 are affixed to the band 2200. In one embodiment, the straps 2210, 2242 are made of the same material as the connectors 2212. The strap 2210 is affixed to the component 2002-L, and the strap 2242 is affixed to the component 2202-B. The straps 2210, 2242 are configured to affix and detach to one another via a collective attachment mechanism. In one embodiment, the strap 2210 includes the loop components of a hook and loop system on the front side of the strap 2210.

Figure 23:
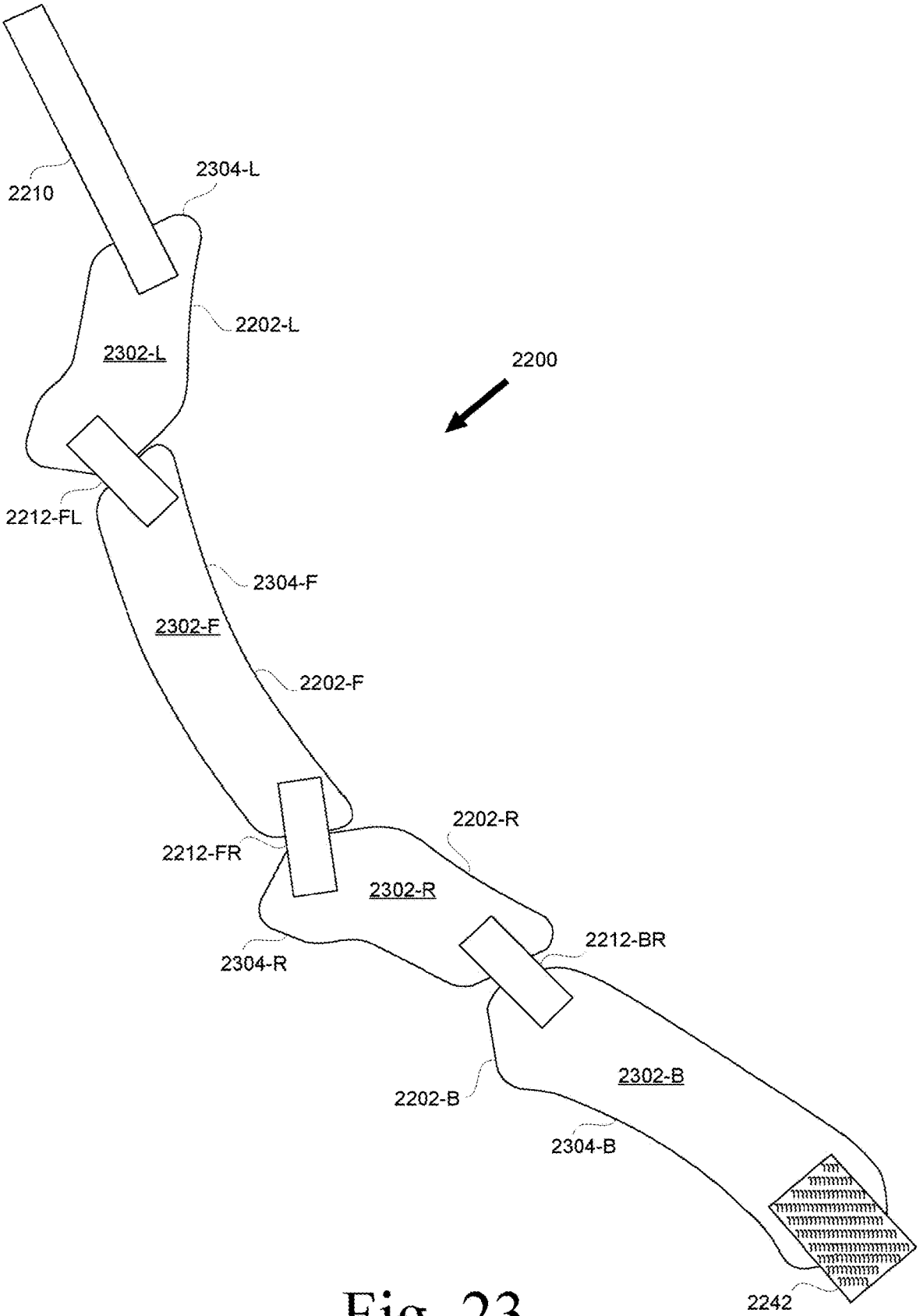
FIG. 23 is a back view of the band shown in FIG. 22.

FIG. 23 illustrates the back of the band 2220. Each component 2202 includes a respective backing 2304-L, 2034-F, 2304-R, and 2304-B. The backings 2304 are flexible and resistant to tearing. In one embodiment, the backings 2304 are made of cloth or nylon. In another embodiment, the backings 2304 are made of flexible plastic. In another embodiment, the backings 2304 are made of FEAM. The backing outer surfaces 2302-L, 2302-F, 2302-R, and 2302-B are covered in a part of an attachment mechanism. In one embodiment, the outer surfaces 2302 are covered in the loop component of a hook-and-loop system.

Each connector 2212 joins two components 2202. The connectors 2212 are permanently affixed to the backings 2304. Connector 2212-FL joins components 2202-L and 2202-F. Connector 2212-FR joins components 2202-F and 2002-R. Connector 2212-BR joins components 2202-B and 2202-R. In some embodiments, the connectors 2212 are stretchable and elastic. In one embodiment, the connectors 2212 are elastic bands.

The back face of the distal strap 2242 includes a component of an attachment mechanism configured to attach to a corresponding attachment mechanism on the front face of the other distal strap 2210. In one embodiment, the back face of distal strap 2242 includes the hook component of a hook-and-loop system.

Figure 24:
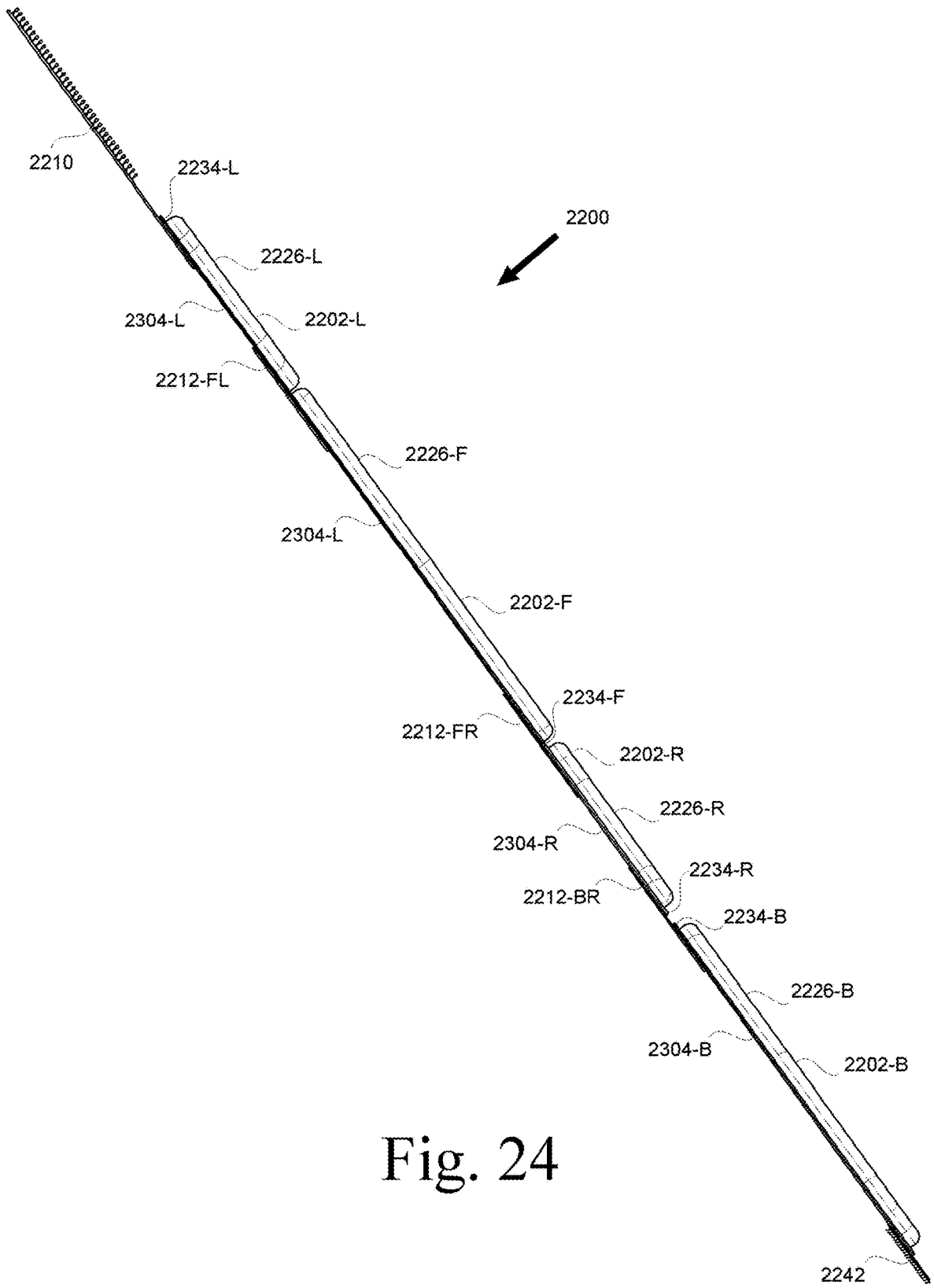
FIG. 24 is a side view of the band shown in FIG. 22.

FIG. 24 illustrates a side of the band 2220. The padding flanges 2234 are flush with, affixed to, the respective backings 2304. In one embodiment, the flanges 2234 are affixed to the backings 2304 via radio-frequency (RF) sealing. In another embodiment, the flanges 2234 are affixed to the backings 2304 via chemical bonding. In one embodiment, the pad undersides (not shown) are also bonded to the respective backings 2304.

Figure 25:
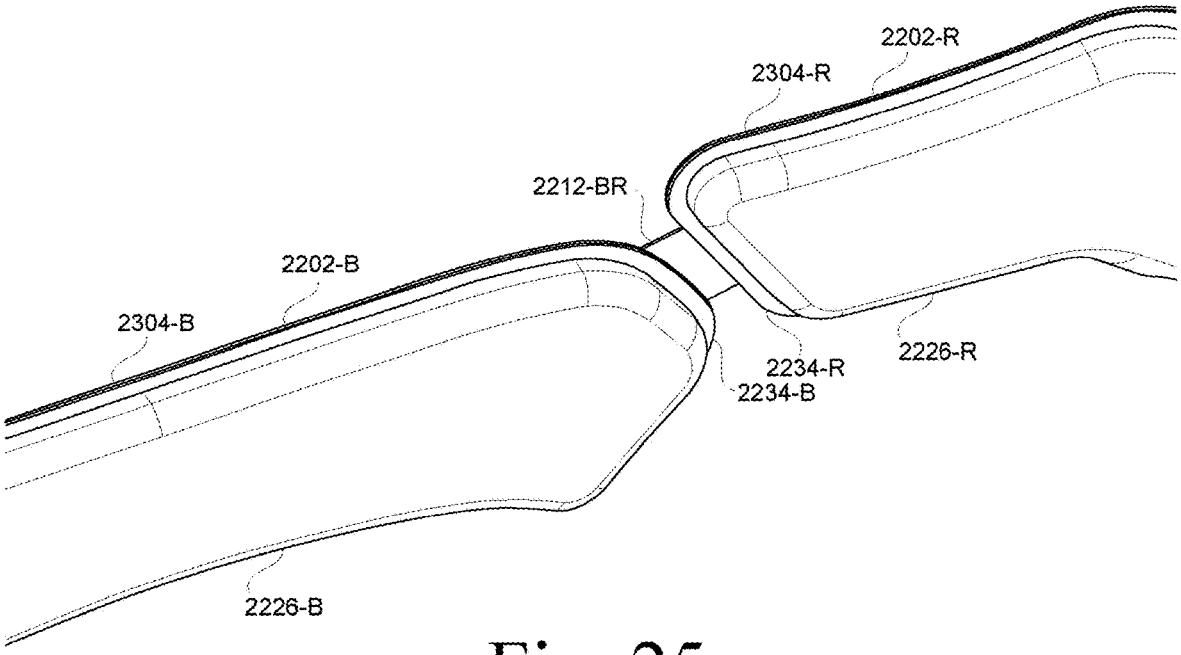
FIG. 25 is a front isometric view of a portion of the band shown in FIG. 22.
Figure 26:
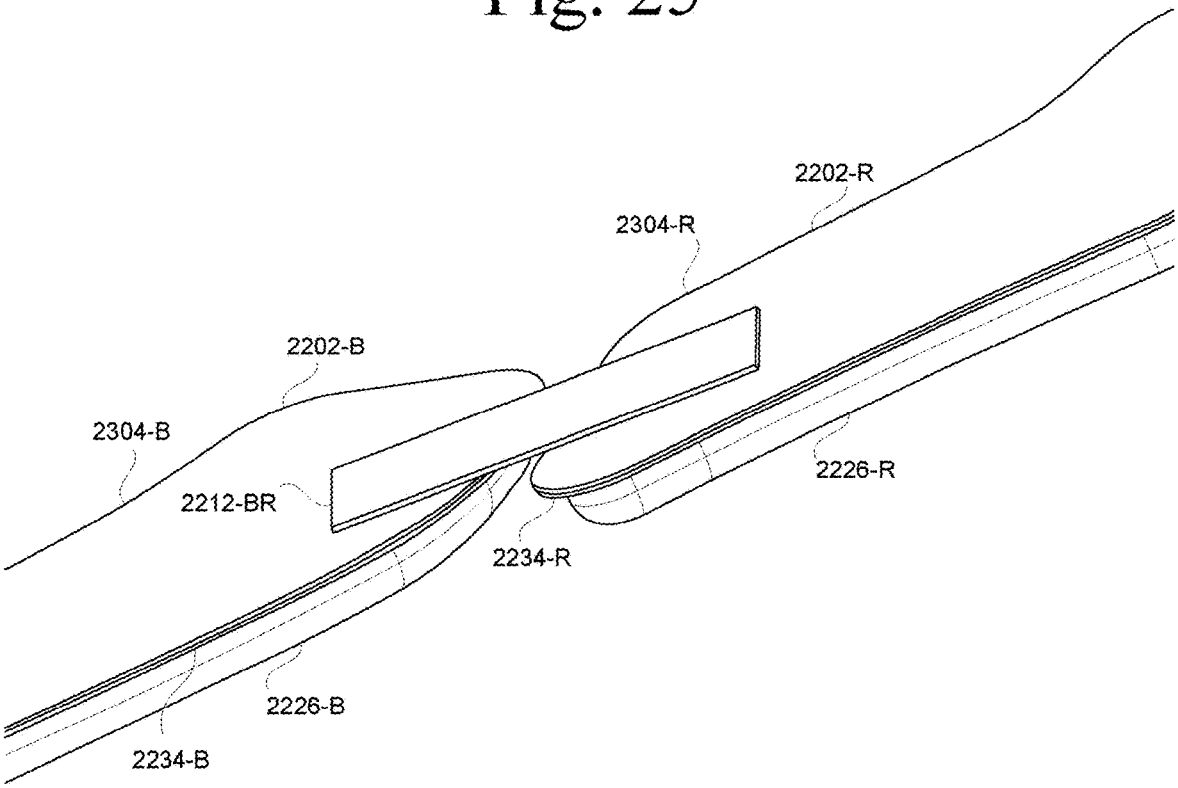
FIG. 26 is a back isometric view of a portion of the band shown in FIG. 22.

FIGS. 25 and 26 illustrate isometric views of representative components 2202 of the band 2200. The pads 2226 are rounded and have no sharp edges. The respective flanges 2234 extend an equidistant amount around each pad 2226. The outer perimeter of the flanges 2234 and respective backings 2304 are identical in size and shape wherein that the flanges 2234 are superposed on the backings 2304 such that their outer edge faces are coplanar.

Figure 27:
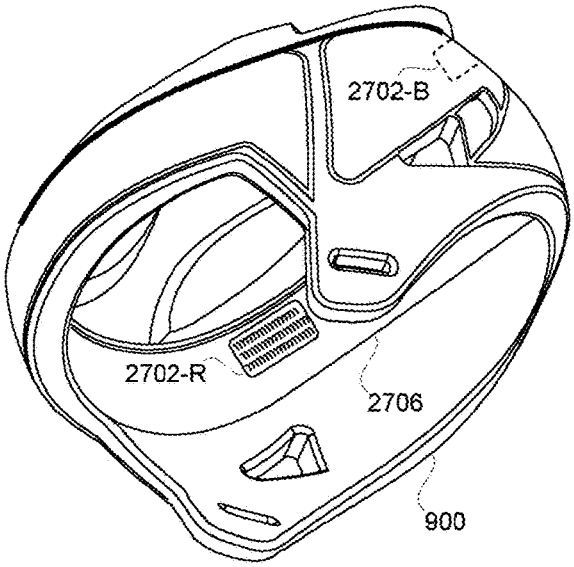
FIG. 27 is a bottom left isometric view of a helmet having attachment mechanisms for an internal band, according to an embodiment of the present disclosure.
Figure 28:
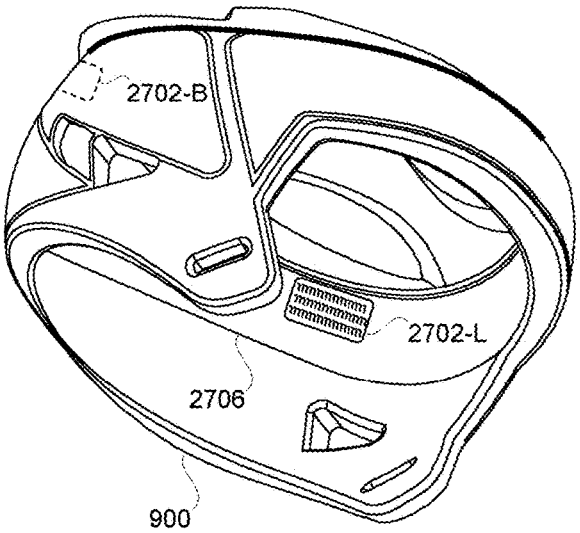
FIG. 28 is a bottom right isometric view of the helmet of FIG. 27.
Figure 29:
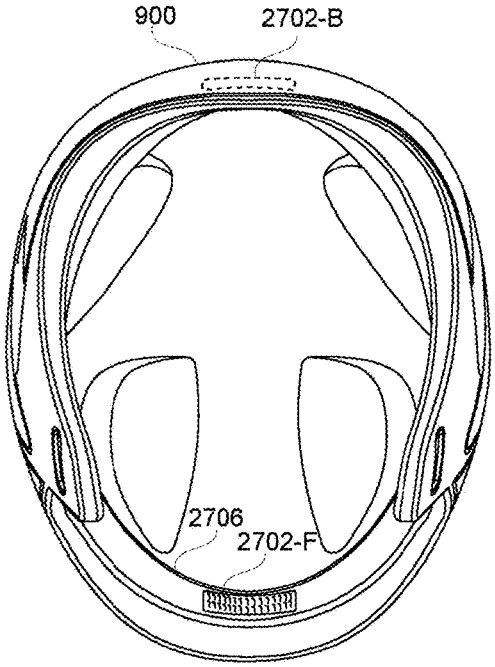
FIG. 29 is a bottom view of the helmet of FIG. 27.

FIGS. 27, 28, and 29 illustrate a helmet 900 with attachment mechanism components 2702-R, 2702-L, 2702-F, and 2702-B. In one embodiment, the components 2702 are the hook portions of a hook and loop system. The components 2702 are located in a recessed channel 2706 that circles around the inner surface of the helmet 900.

A method of use for the band 2200 in conjunction with the helmet will now be described. The wearer encircles the band 2200 around the wearer's head, with the pads 2226 facing inward and resting against the head. The pad 2226-F rests across the forehead, the pad 2226-R rests across the right temple, the pad 2226-L rests across the left temple, and the pad 2226-B rests across the back of the head.

Once the band 2200 is correctly wrapped and positioned around the head, the distal straps 2210 and 2242 are affixed to one another at appropriate locations for sizing to create an exact encircling fit for the particular wearer's head. Once the encircled band 2200 of an appropriate size has been created, the band 2220 is removed from the wearer's head. The back surfaces 2302 are attached to the four corresponding attachment components 2702 inside the helmet 900. The encircling band 2200 fits inside the channel 2706. Because the components 2702 may be attached essentially anywhere on the respective back surfaces 2302 and are attached at only four discrete patches on the helmet 900, there needs to be little or no distortion of the original fitted diameter sizing of the band 2200. The wearer is then able to put on the helmet 900 where the inner pads 2226 are fitted for the particular wearer's head.

In another method of use, the band 2200 is used without a helmet, for example in protection in soccer while heading balls. The pads 2226 face outward from the wearer while the back surfaces 2302 are flush against the wearer's head. The distal straps 2210 and 2242 are joined such that the encircling band 2200 is sufficiently tight not to fall off during use.

In one embodiment, the pads 2226 are made of FEAM layers wherein each FEAM layer is capable of shifting laterally relative to the backing 2304, thereby reducing rotational impacts to the wearer's head. For example, where the back surfaces 2302 are affixed in place to the inner surface of the helmet 900 and the pad surfaces 2218 are pressed against the wearer's head, the laterally shifting FEAM layers allow the back surfaces 2302 to rotate more than the pad surfaces 2218 when the helmet receives an external rotational impact. Thus, upon impact, the wearer's head rotates less than the outer surface of the helmet 900.

Figure 30:
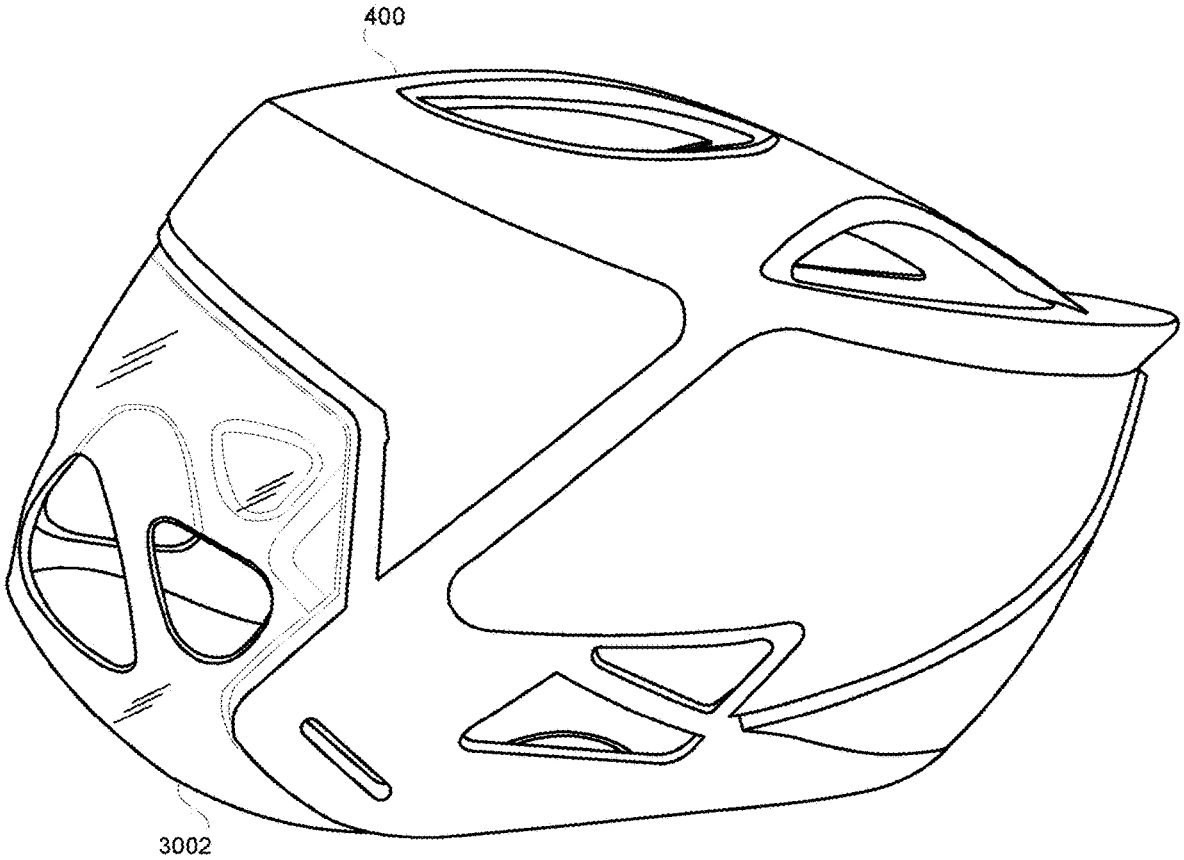
FIG. 30 is a side perspective view of a helmet with a face mask according to an embodiment of the present disclosure.
Figure 31:
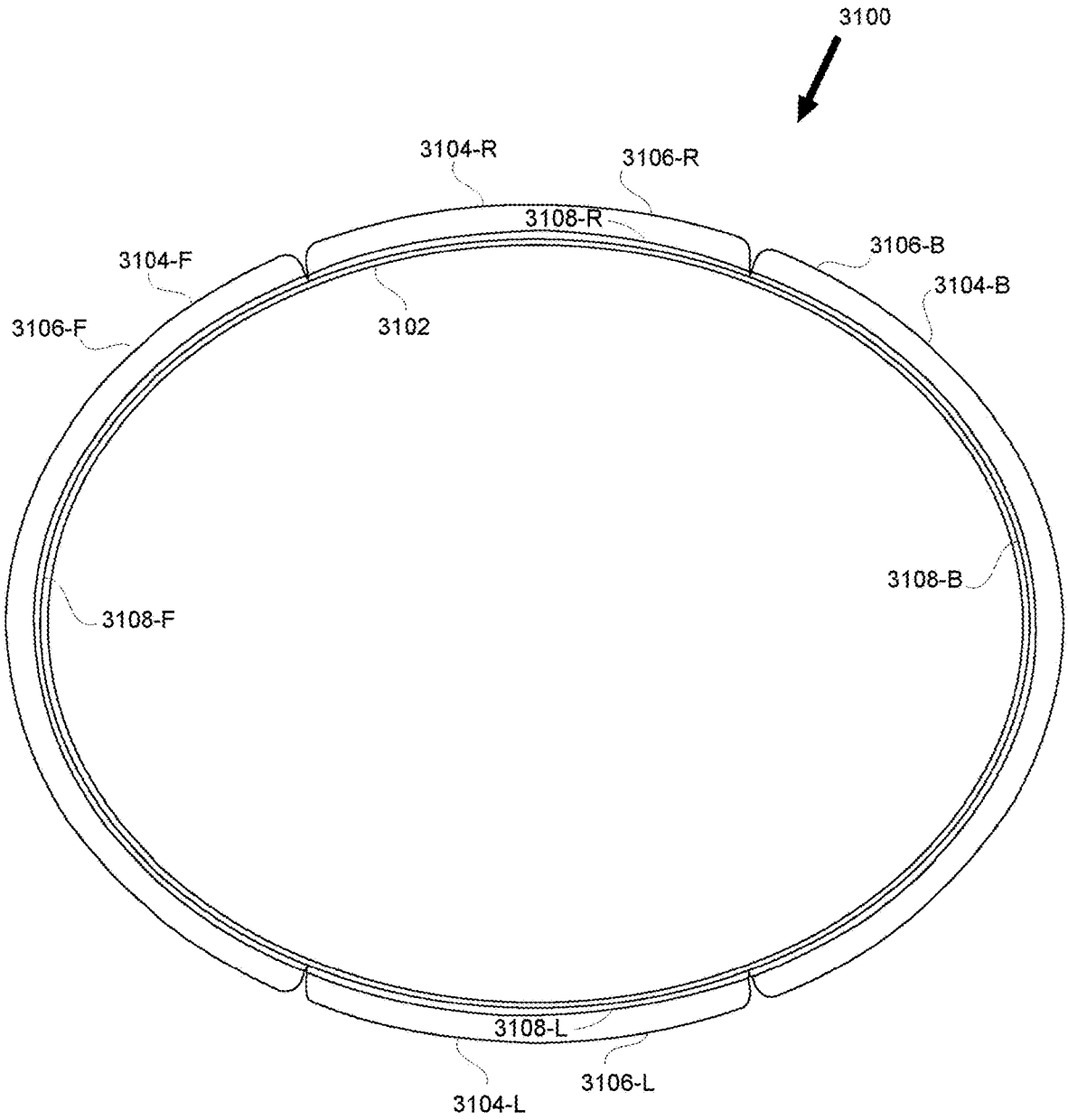
FIG. 31 is a top view of a band according to another embodiment of the present disclosure.
Figure 32:
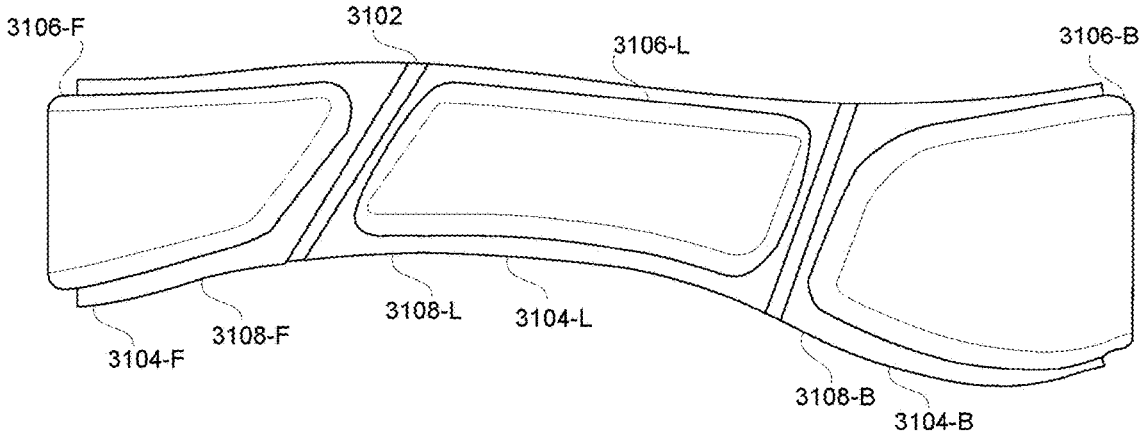
FIG. 32 is a left side view of the band shown in FIG. 31.
Figure 33:
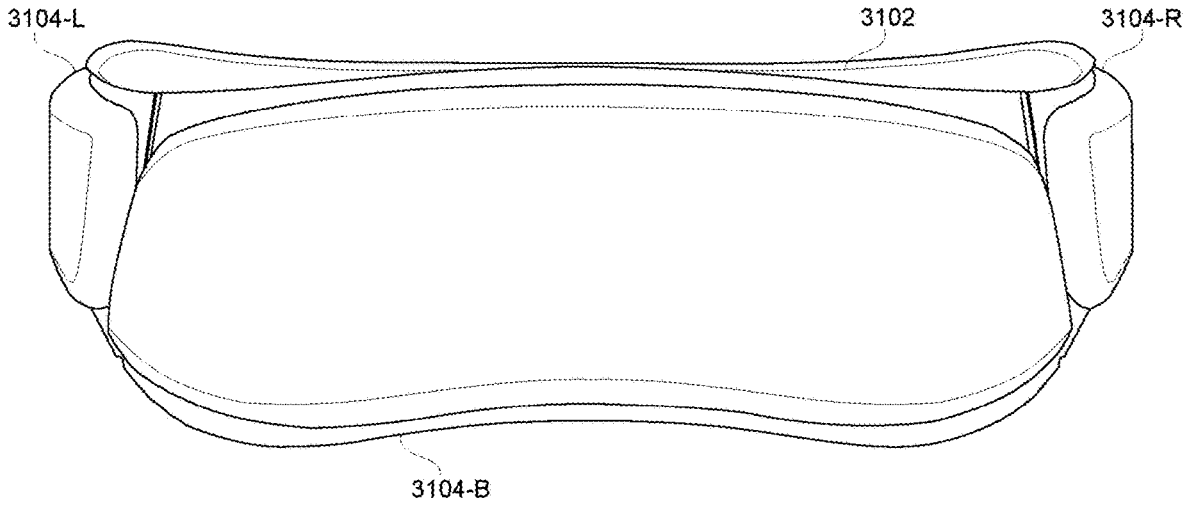
FIG. 33 is a back view of the band shown in FIG. 31.
Figure 34:
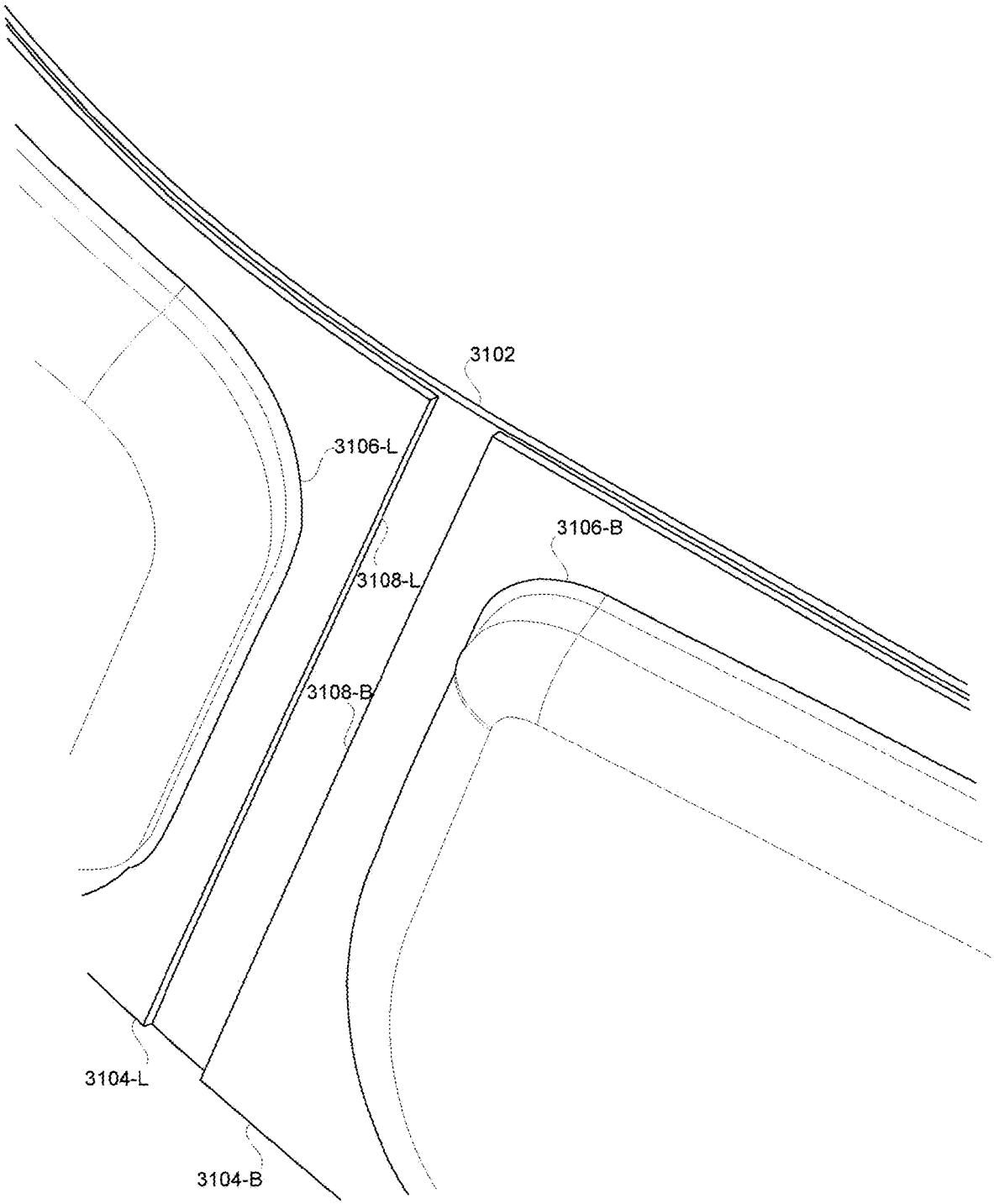
FIG. 34 is an isometric view of a portion of the band shown in FIG. 31.

FIG. 30 illustrates a face shield 3002 affixed to the helmet 900. The shield 3002 is transparent and made of a hard rigid material, such as a high-impact polycarbonate.

FIGS. 31, 32, 33, and 34 illustrate a band 3200. An inner loop 3102 is made from sweatband materials, for example one or more of the materials of terry cloth, microfiber, bamboo fabric, polyester, and nylon. Individual components 3104-F, 3104-R, 3104-B, and 3104-L are affixed to the loop 3102 but not directly affixed to each other.

Each component 3104 includes a respective pad 3106-R, 3106-F, 3106-B and 3106-L. The pads 3106 are soft, resilient, and resistant to tearing. In one embodiment, the pads 3106 include inner foam material (not shown) encapsulated in vacuum-formed pouches having flange perimeters 3108-R, 3108-F, 3108-B, and 3108-R. The flanges 3108 are each permanently affixed to the loop 3102. In one embodiment, the loop 3102 and flanges 3108 are affixed to one another via RF sealing.

In one method of use, the loop 3102 is placed on the wearer's head in a manner similar to a sweatband, such that the component 3102-F faces outward from the wearer's forehead, the component 3102-R faces outward from the wearer's right temple, the component 3102-L faces outward from the wearer's left temple, and the component 3102-B faces outward from the back of the wearer's head. Thus, impact force on the wearer's head is reduced from incidental contact, as well as from intentional head use, i.e., heading a soccer ball.

FIGS. 35 through 46 illustrate pads 3502 for the inside of a helmet 4702. The pads 3052 are soft, bendable, and resilient. In one embodiment, the pads 3052 are made of polyurethane foam. The pads 3052 are attachable and detachable from their respective recesses 4802 inside the helmet 4702. In one embodiment, the pads are made of polyurethane foam.

Figure 35:
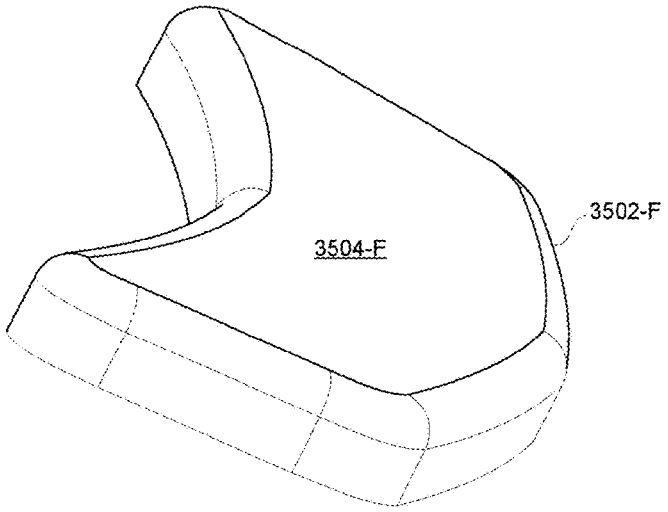
FIG. 35 is an isometric view of an inner pad according to an embodiment of the present disclosure.
Figure 36:
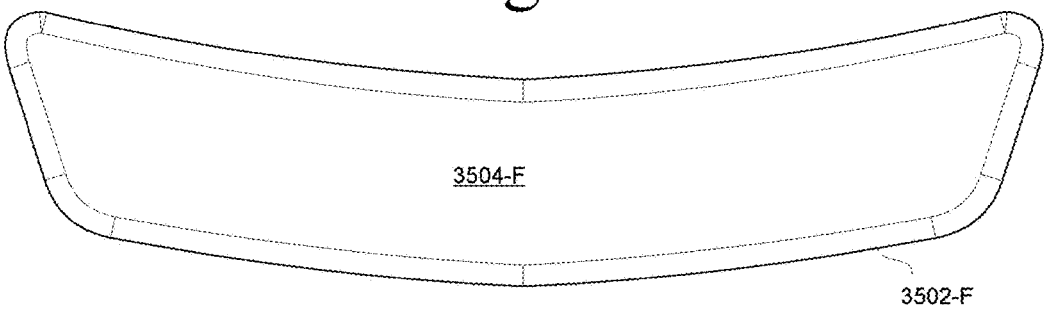
FIG. 36 is a front view of the pad shown in FIG. 35 according to an embodiment of the present disclosure.
Figure 37:
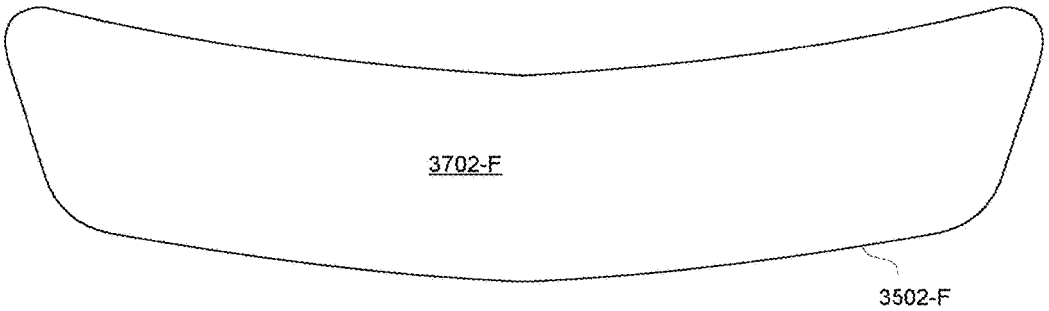
FIG. 37 is a back view of the pad shown in FIG. 35 according to an embodiment of the present disclosure.

FIGS. 35, 36, and 37 illustrate a front pad 3502-F. The surface 3504-F is radiused. The surface 3702-F is flat. The surface 3702-F includes a portion of an attachment mechanism, for example hooks or loops in a hook-and-loop attachment system.

Figure 38:
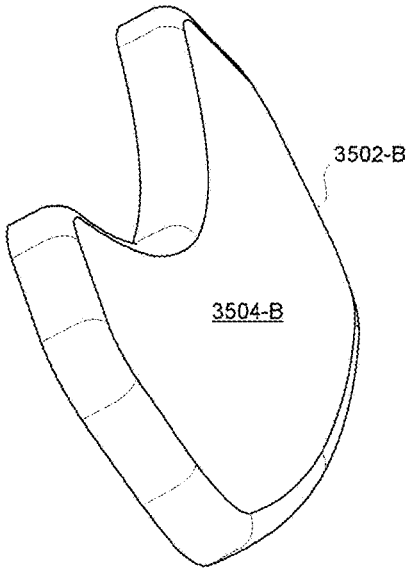
FIG. 38 is an isometric view of an inner pad according to an embodiment of the present disclosure.
Figure 39:
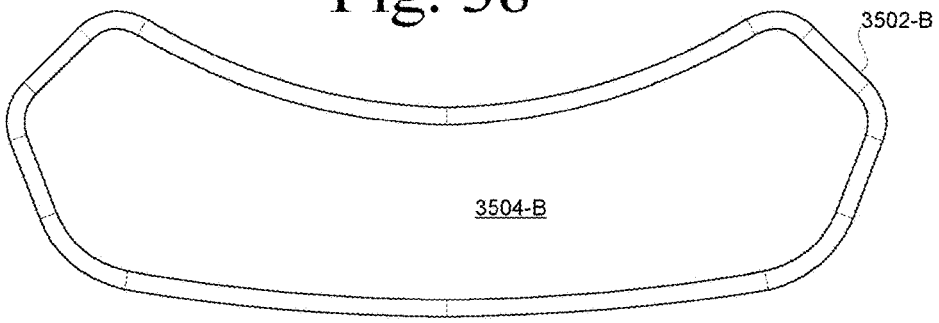
FIG. 39 is a front view of the pad shown in FIG. 38.
Figure 40:
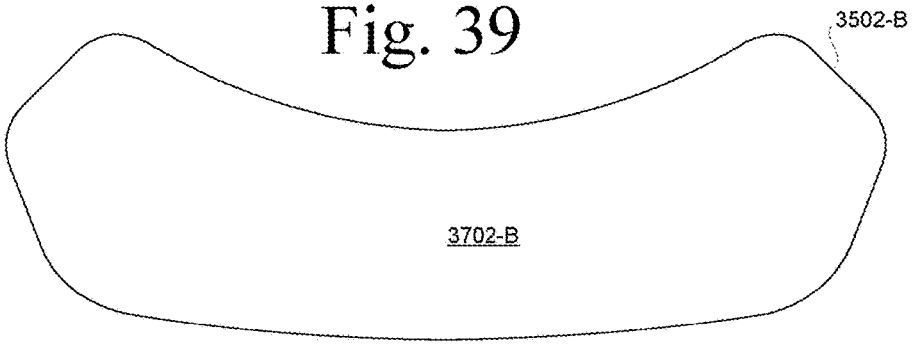
FIG. 40 is a back view of the pad shown in FIG. 38.

FIGS. 38, 39, and 40 illustrate a rear pad 3502-B. The surface 3504-B is radiused. The surface 3702-B is flat. The surface 3702-B includes a portion of an attachment mechanism, for example hooks or loops in a hook-and-loop attachment system.

Figure 41:
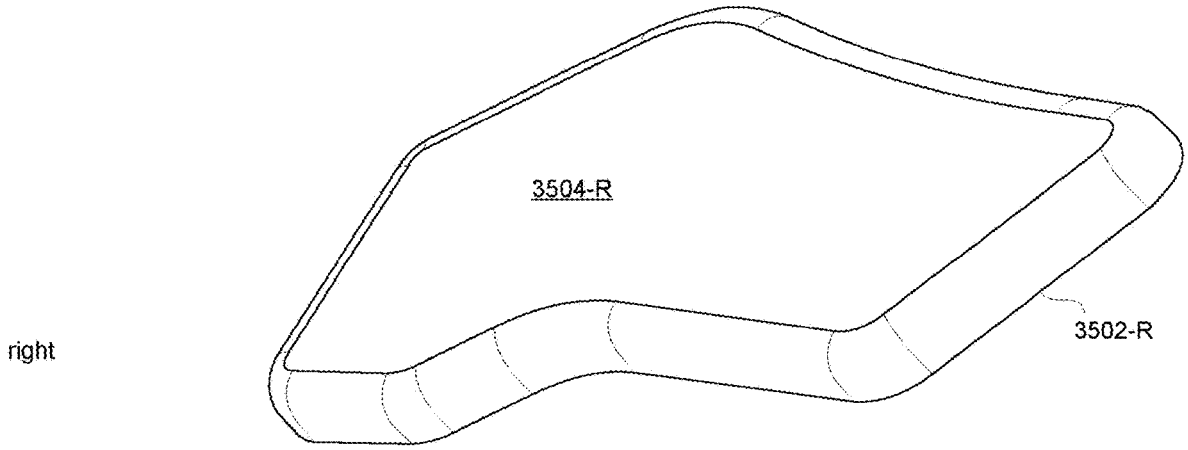
FIG. 41 is an isometric view of an inner pad according to an embodiment of the present disclosure.
Figure 42:
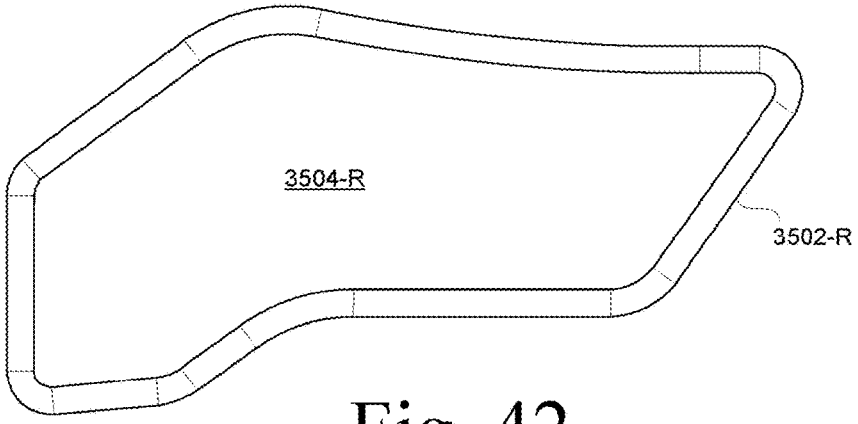
FIG. 42 is a front view of the pad shown in FIG. 41.
Figure 43:
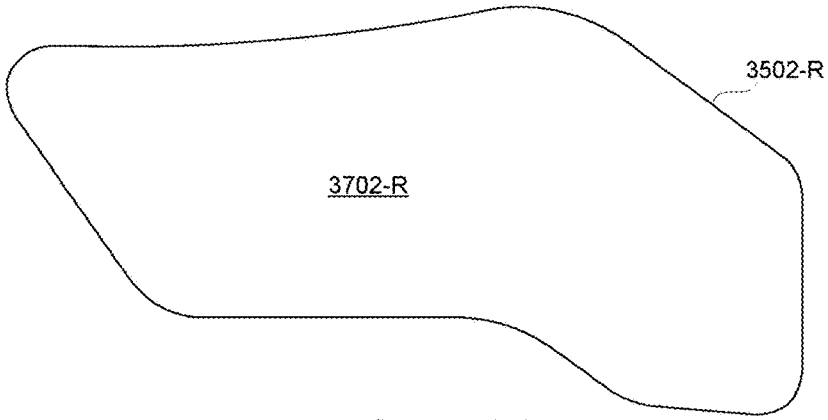
FIG. 43 is a back view of the pad shown in FIG. 41.

FIGS. 41, 42, and 43 illustrate a right pad 3502-R. The surface 3504-R is radiused. The surface 3702-R is flat. The surface 3702-R includes a portion of an attachment mechanism, for example hooks or loops in a hook-and-loop attachment system.

Figure 44:
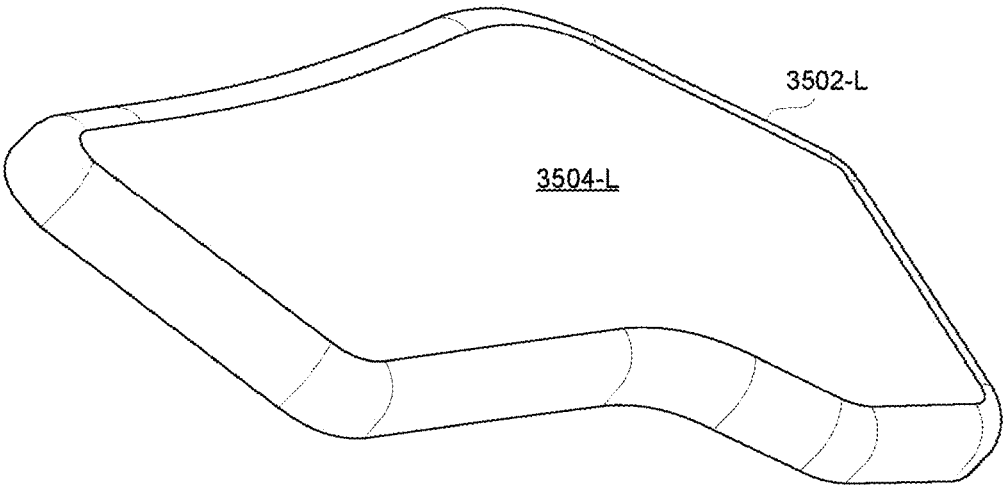
FIG. 44 is an isometric view of an inner pad according to an embodiment of the present disclosure.
Figure 45:
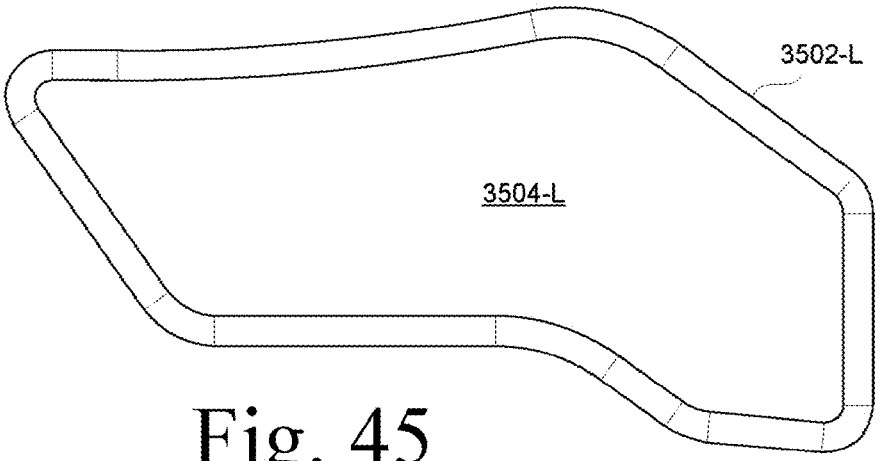
FIG. 45 is a front view of the pad shown in FIG. 44.
Figure 46:
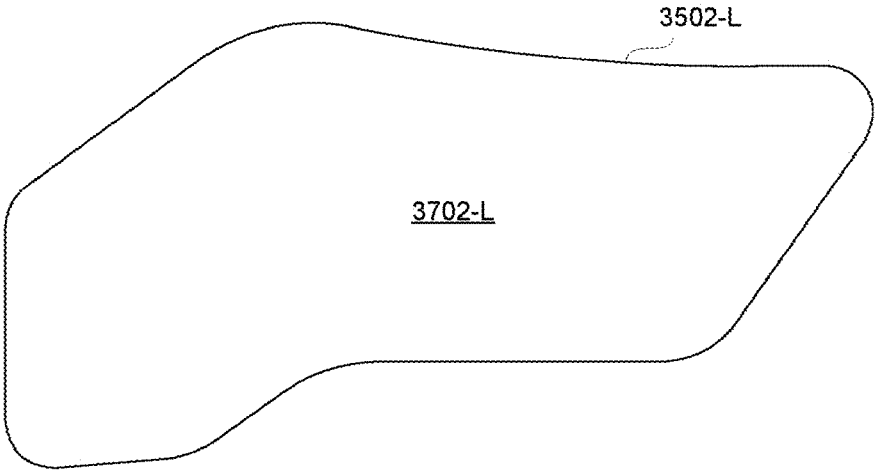
FIG. 46 is a back view of the pad shown in FIG. 44.

FIGS. 44, 45, and 46 illustrate a left pad 3502-L. The surface 3504-L is radiused. The surface 3702-L is flat. The surface 3702-L includes a portion of an attachment mechanism, for example hooks or loops in a hook-and-loop attachment system.

Figure 47:
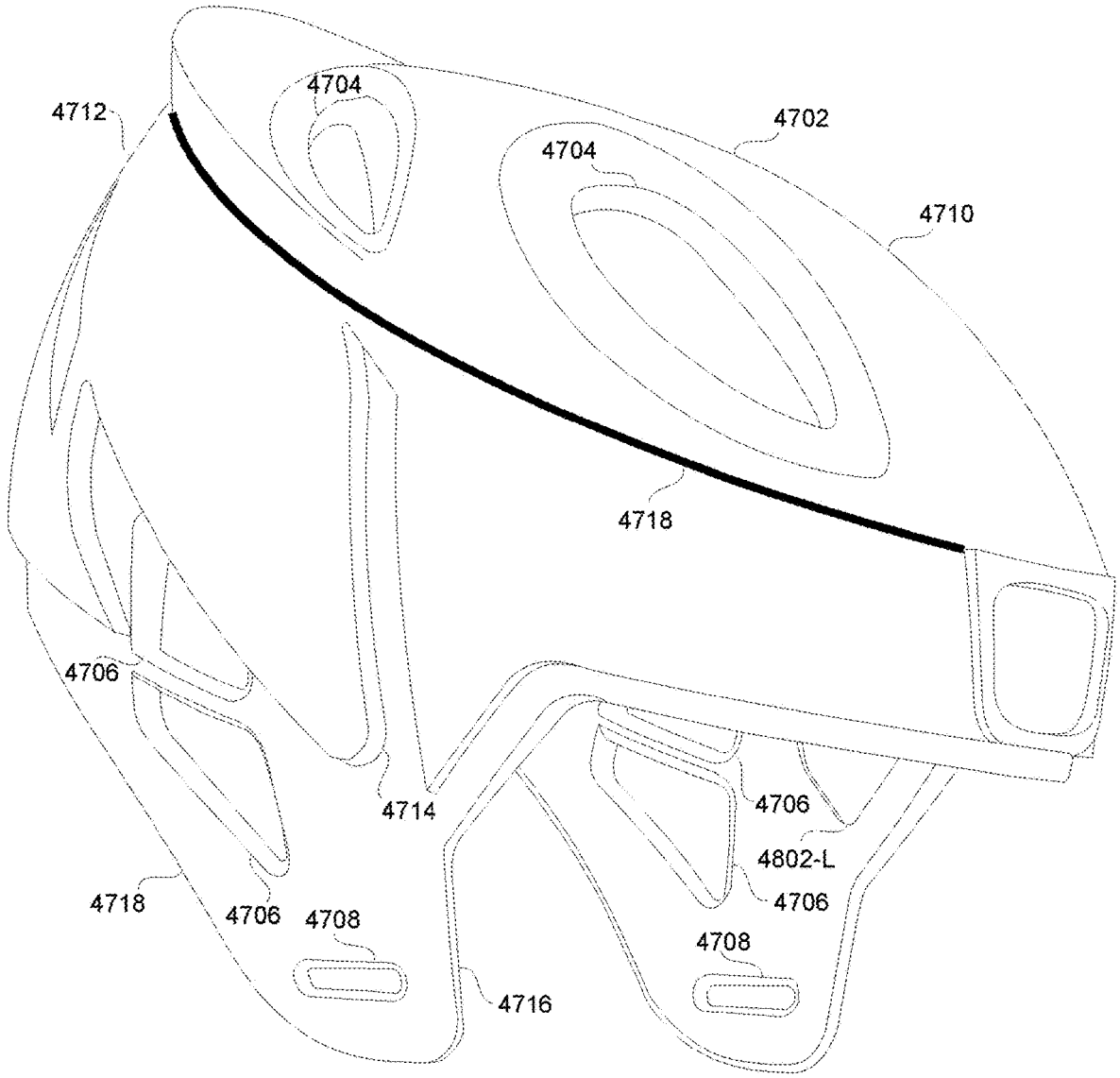
FIG. 47 is an isometric view of a helmet according to an embodiment of the present disclosure.

FIG. 47 illustrates a helmet 4702. A top section 4710 is affixed to a bottom section 4716 along 4718. The top section 4710 is made of a harder material than the bottom section 4716. In one embodiment, the bottom section 4716 is made of polyurethane foam. In one embodiment, the top section 4710 is made of injection-molded low durometer polyurethane, with a Shore hardness of approximately thirty. A portion of the bottom section 4716 nearest the top section 4710 has an extra layer 4714 of thickness, which provides greater protection to the wearer while allowing the lower single-layer section to be sufficiently flexible to bend open to accommodate the wearer's head and bend together when a strap is threaded through the apertures 4708 and tightened.

Multiple upper vents 4704 and lower vents 4706 extend through the helmet 4702, allowing for cooling and ventilation. The lower vents 4706 are positioned and configured to expose completely the opening of the auditory canal of the wearer's ears, such that the helmet does not interfere with the wearer's hearing.

Figure 48:
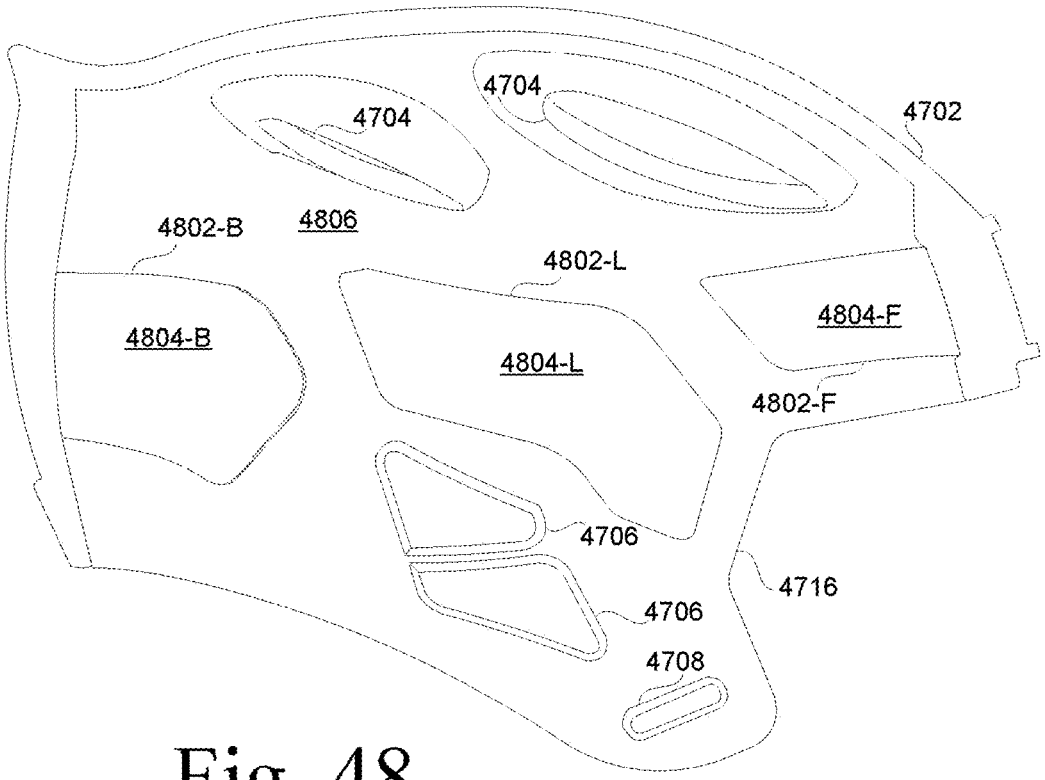
FIG. 48 is a side cross-section view of the helmet shown in FIG. 47.
Figure 49:
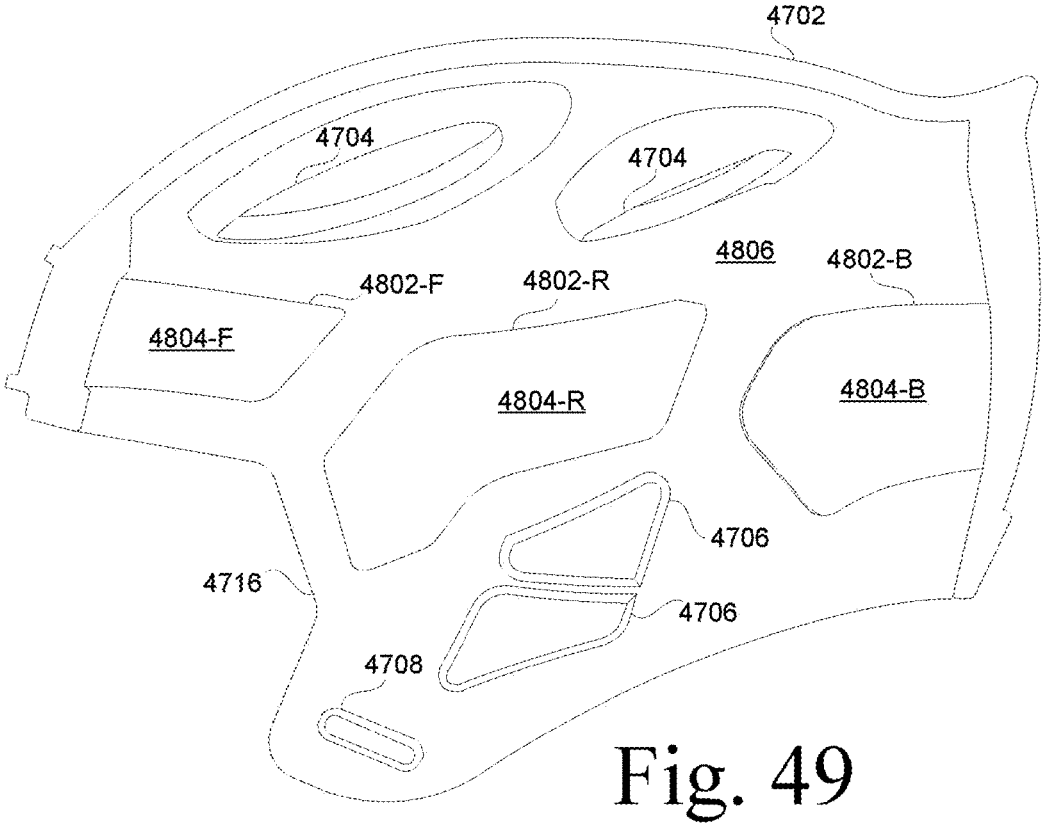
FIG. 49 is a side cross-section view of the helmet shown in FIG. 47.
Figure 50:
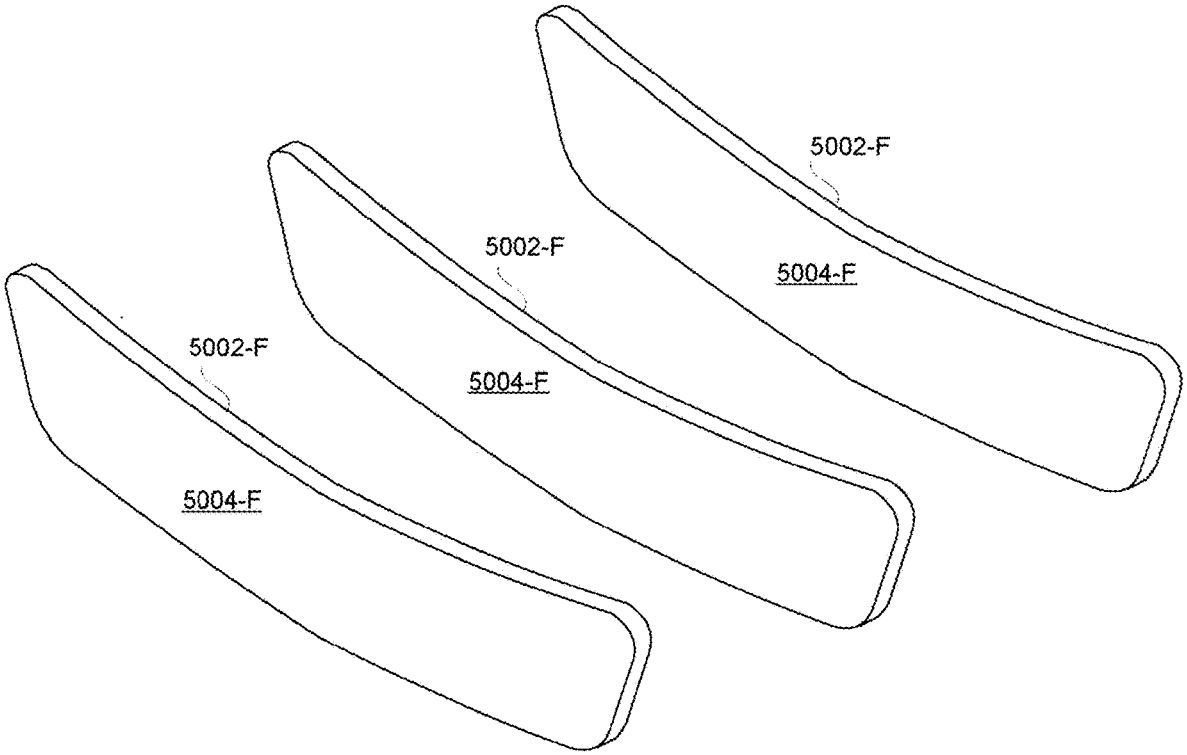
FIG. 50 is an isometric view of a set of shims according to an embodiment of the present disclosure.
Figure 51:
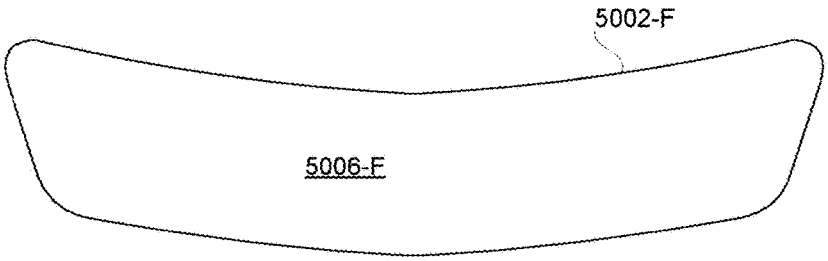
FIG. 51 is a front view of a shim shown in FIG. 50.
Figure 52:
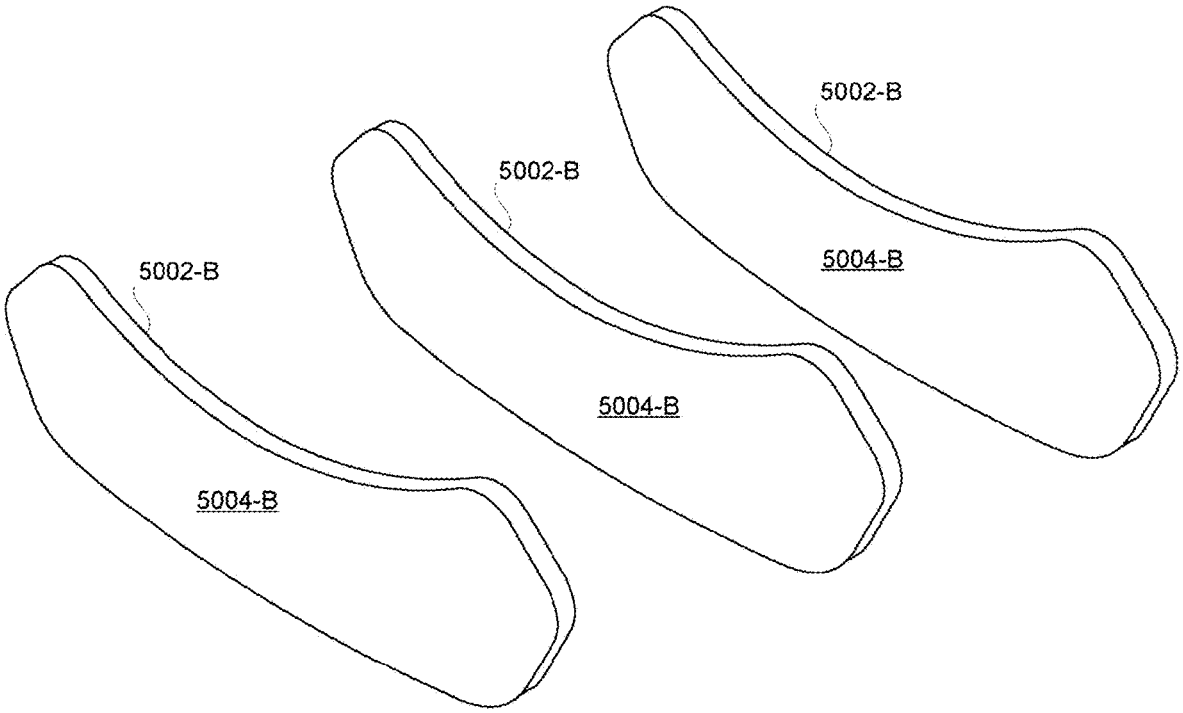
FIG. 52 is an isometric view of another set of shims.
Figure 53:
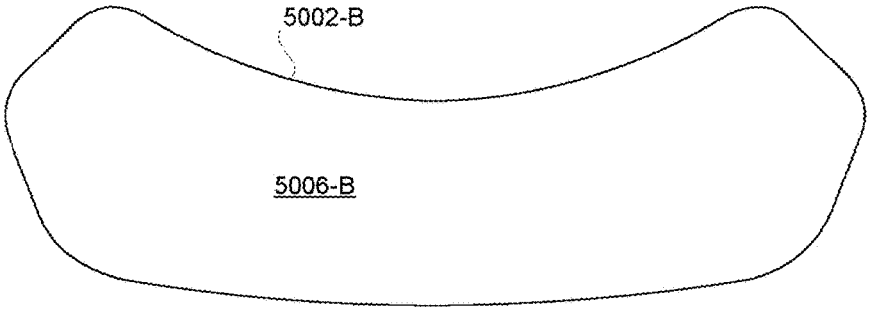
FIG. 53 is a front view of a shim shown in FIG. 52.
Figure 54:
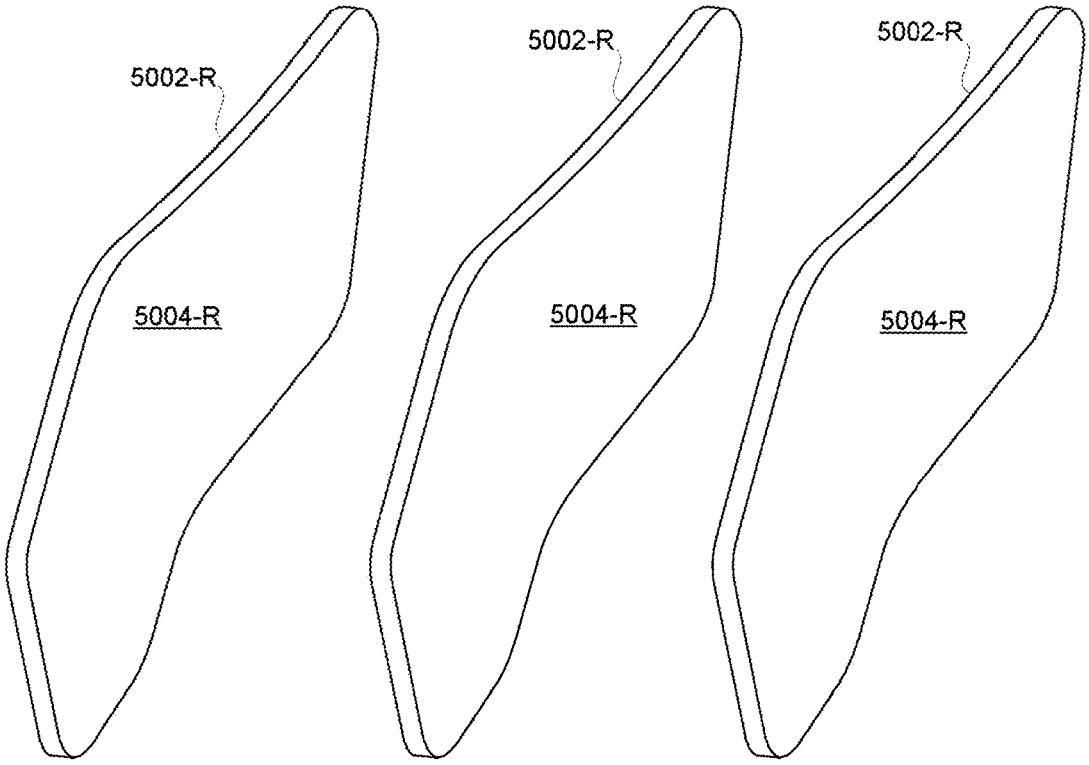
FIG. 54 is an isometric view of another set of shims according to an embodiment of the present disclosure.
Figure 55:
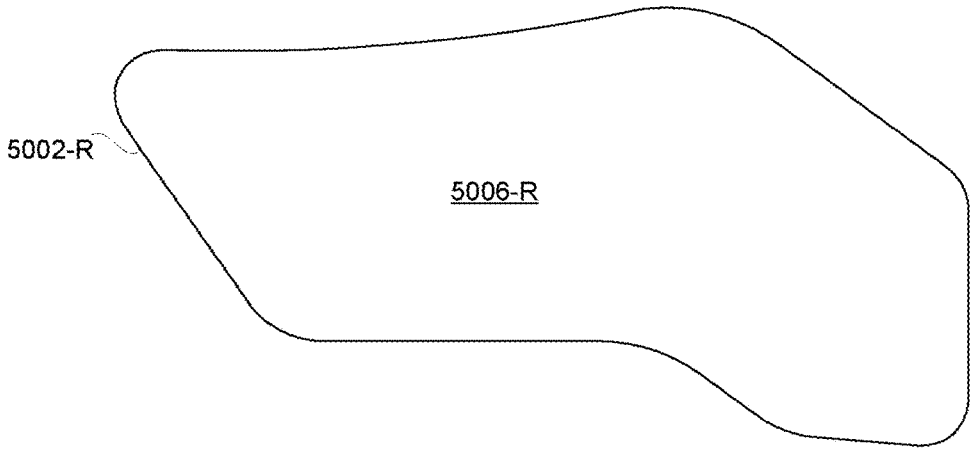
FIG. 55 is a front view of a shim shown in FIG. 54.
Figure 56:
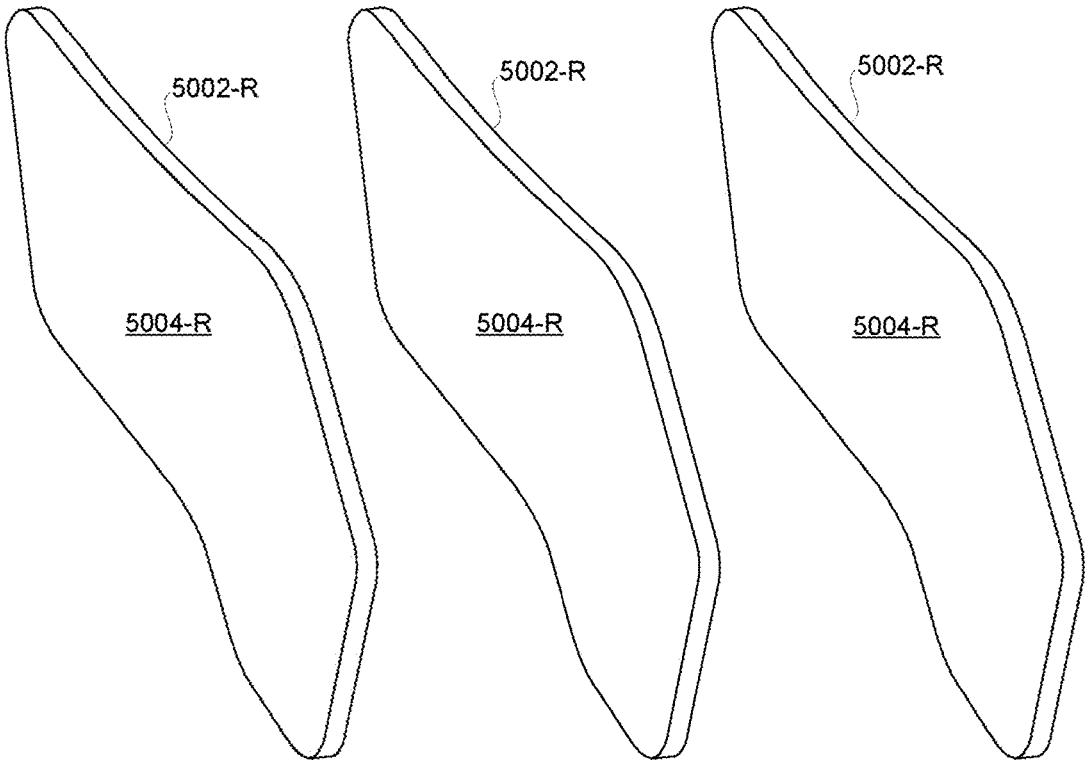
FIG. 56 is an isometric view of another set of shims according to an embodiment of the present disclosure.
Figure 57:
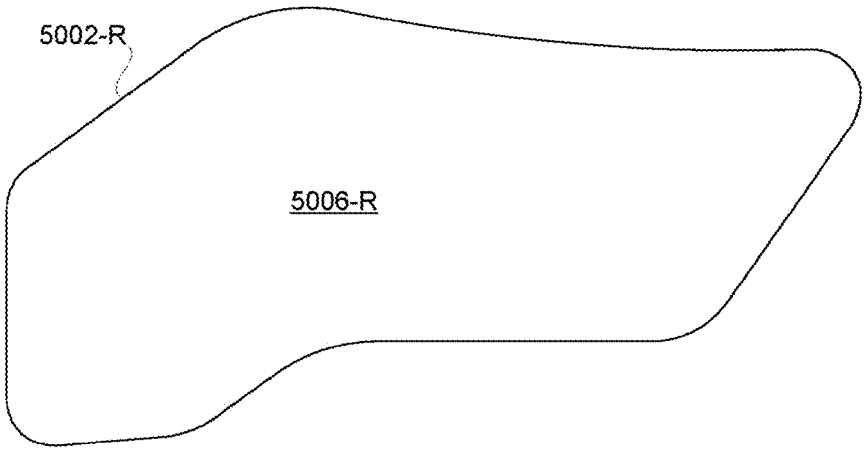
FIG. 57 is a front view of a shim shown in FIG. 56.

FIGS. 48 and 49 are opposing cross-section views that collectively illustrate the inner surface 4806 of the helmet 4702. Multiple recesses 4802 are each configured to receive a respective pad 3502 that fills the recess 4804 and extends beyond the recess 4804 to contact the wearer's head.

The front pad 3502-F includes a surface 3702-F whose perimeter is equal in size and shape to the perimeter of the bottom surface 4804-F front recess 4802-F. In one embodiment, the pad surface 3702-F and the bottom surface 4804-F include corresponding components of a hook and loop system. The front pad 3502-F fills the front recess 4802-F, and the pad surface 3504-F extends beyond the front recess 4802-F such that the front pad 3502-F is configured to presses against the wearer's forehead.

The back pad 3502-B includes a surface 3702-B whose perimeter is equal in size and shape to the perimeter of the bottom surface 4804-B back recess 4802-B. In one embodiment, the pad surface 3702-B and the bottom surface 4804-B include corresponding components of a hook and loop system. The back pad 3502-B fills the back recess 4802-B, and the pad surface 3504-B extends beyond the back recess 4802-B such that the back pad 3502-B is configured to presses against the back of the wearer's head.

The right pad 3502-R includes a surface 3702-R whose perimeter is equal in size and shape to the perimeter of the bottom surface 4804-R right recess 4802-R. In one embodiment, the pad surface 3702-R and the bottom surface 4804-R include corresponding components of a hook and loop system. The right pad 3502-R fills the right recess 4802-R, and the pad surface 3504-R extends beyond the back recess 4802-R such that the right pad 3502-R is configured to press against the right side of the wearer's head, including the wearer's right temple and the right side of the wearer's face.

The left pad 3502-L includes a surface 3702-L whose perimeter is equal in size and shape to the perimeter of the bottom surface 4804-L left recess 4802-L. In one embodiment, the pad surface 3702-L and the bottom surface 4804-L include corresponding components of a hook and loop system. The left pad 3502-L fills the left recess 4802-L, and the pad surface 3504-L extends beyond the back recess 4802-L such that the left pad 3502-L is configured to press against the left side of the wearer's head, including the wearer's left temple and the left side of the wearer's face.

The helmet 4702 is an effective safety device against side impacts to the wearer's cranium. The top section 4710 is made of a resilient but stiffer material, and assists the helmet in keeping its form during use. The middle section 4714 is thick and resilient but made of a material softer than the top section 4710. The majority of the surface area of the inner recesses 4804 are located at the middle section, such that the majority of the padding 3502 is located in the middle section. The bottom section 4718 is made of the same material as the middle section 4714 but is thinner, thereby allowing for the helmet 4702 to be sufficiently flexible to contour to the wearer's head and face.

FIGS. 50 through 57 illustrate shims 5002. Each shim 5002 is configured to fit in their respective recess 4804 and between the respective surfaces 4804, 3702 in order to extend the pads 3052 further into the middle of the inside of the helmet 4702. The shims 5002 are flexible and resilient. Multiples of each shim 5002 can be used to properly fit the pads 3502 against the wearer's head.

The front shim 5002-F is thinner than the front pad 3502-F. The front shim 5002-F has a uniform thickness. The front shim 5002-F has opposing surfaces 5004-F, 5006-F that have the same perimeter size and shape as the front surface 4804-F. The front shim 5002-F is configured to fit in the front recess 4804-F. The front shim 5002-F is attachable and detachable from the surface 4804-F and the surface 3702-F. The front shim 5002-F is configured to sandwich between the front pad 3502-F and recess surface 4804-F. The shim surface 5006-F is configured to attach and detach to the recess surface 4804-F. The shim surface 5004-F is configured to attach and detach to the pad surface 3702-F. In one embodiment, the attachment mechanisms on the shim surfaces 5004-F, 5006-F are opposing components of a hook and loop system.

The back shim 5002-B is thinner than the back pad 3502-B. The back shim 5002-B has a uniform thickness. The back shim 5002-B has opposing surfaces 5004-B, 5006-B that have the same perimeter size and shape as the back surface 4804-B. The back shim 5002-B is configured to fit in the back recess 4804-B. The back shim 5002-B is attachable and detachable from the surface 4804-B and the surface 3702-B. The back shim 5002-B is configured to sandwich between the back pad 3502-B and recess surface 4804-B. The shim surface 5006-B is configured to attach and detach to the recess surface 4804-B. The shim surface 5004-B is configured to attach and detach to the pad surface 3702-B. In one embodiment, the attachment mechanisms on the shim surfaces 5004-B, 5006-B are opposing components of a hook and loop system.

The right shim 5002-R is thinner than the right pad 3502-R. The right shim 5002-R has a uniform thickness. The right shim 5002-R has opposing surfaces 5004-R, 5006-R that have the same perimeter size and shape as the right surface 4804-R. The right shim 5002-R is configured to fit in the right recess 4804-R. The right shim 5002-R is attachable and detachable from the surface 4804-R and the surface 3702-R. The right shim 5002-R is configured to sandwich between the right pad 3502-R and recess surface 4804-R. The shim surface 5006-R is configured to attach and detach to the recess surface 4804-R. The shim surface 5004-R is configured to attach and detach to the pad surface 3702-R. In one embodiment, the attachment mechanisms on the shim surfaces 5004-R, 5006-R are opposing components of a hook and loop system.

The left shim 5002-L is thinner than the left pad 3502-L. The left shim 5002-L has a uniform thickness. The left shim 5002-L has opposing surfaces 5004-L, 5006-L that have the same perimeter size and shape as the left surface 4804-L. The left shim 5002-L is configured to fit in the left recess 4804-L. The left shim 5002-L is attachable and detachable from the surface 4804-L and the surface 3702-L. The left shim 5002-L is configured to sandwich between the left pad 3502-L and recess surface 4804-L. The shim surface 5006-R is configured to attach and detach to the recess surface 4804-R. The shim surface 5004-R is configured to attach and detach to the pad surface 3702-R. In one embodiment, the attachment mechanisms on the shim surfaces 5004-R, 5006-R are opposing components of a hook and loop system.

Figure 58:
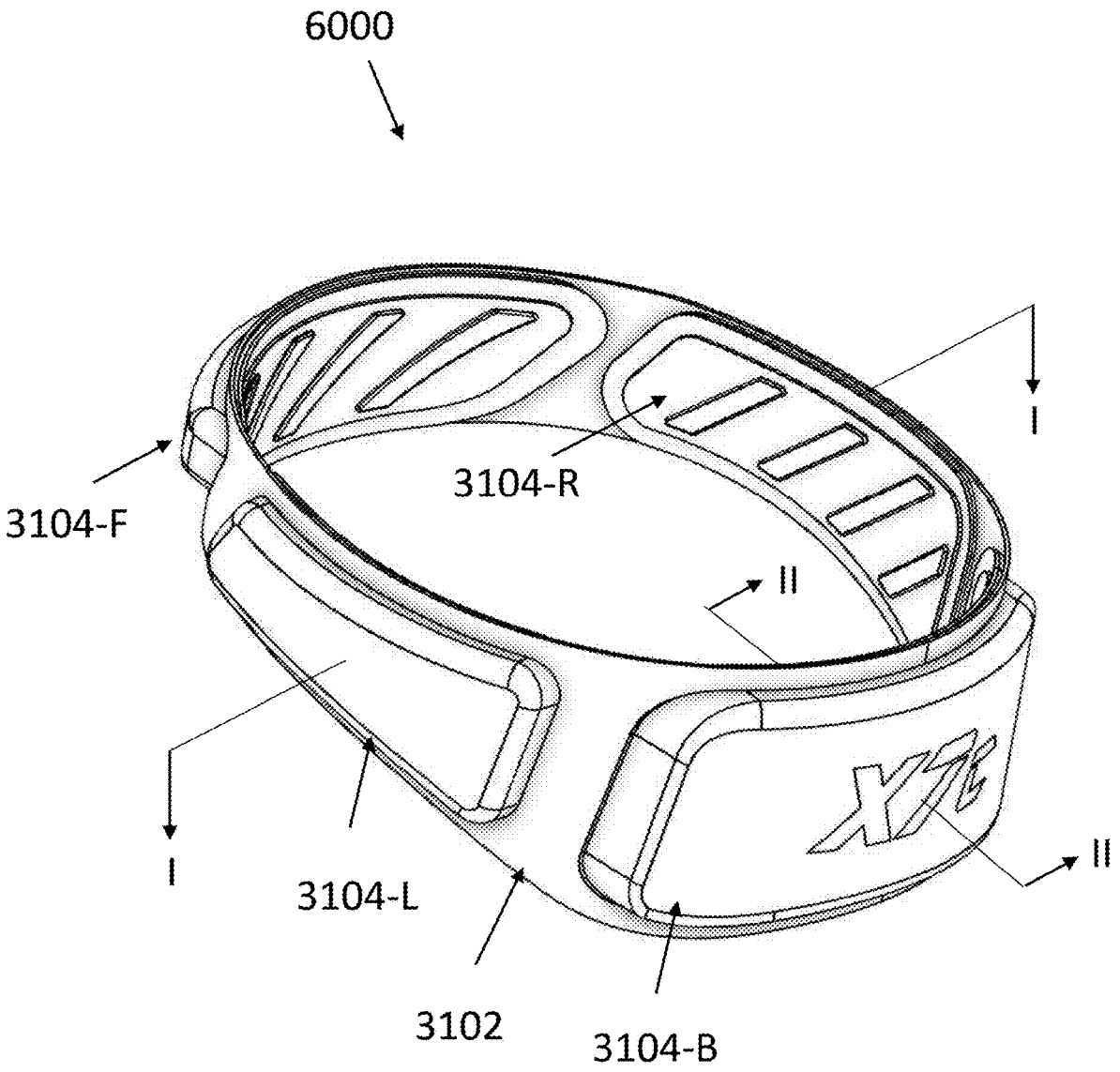
FIG. 58 is a perspective view of a headband according to another embodiment of the present disclosure.

Another embodiment of the present disclosure is a protective headband article 6000, as shown in FIG. 58-61. The protective headband 6000 shown in FIGS. 58-61 is similar to the headband 3200 shown in FIGS. 31-34 and where appropriate, the same reference numbers are used for features that are common to headband 3200 and headband 6000. Referring to FIG. 58, the protective article 6000 is configured as a headband for a head of a wearer. The headband 6000 generally includes a continuous loop 3102 configured to encircle the head of the wearer and multiple pad assemblies 3104 positioned at and coupled to locations around the continuous loop 3102. The headband 6000 includes an open top, an open bottom so that an inner surface is configured to directly contact a portion of a head of the wearer when the protective headband is worn. In the embodiment shown, the headband 6000 includes a front pad assembly 3104-F coupled to the elastic substrate loop 3102, a rear pad assembly 3104-B coupled to the elastic substrate loop 3102 and opposite the front pad assembly 3104-F, a left side pad assembly 3104-L coupled to the elastic substrate loop 3102 and positioned between the front pad assembly 3104-F and the rear pad assembly 3104-B, and a right side pad assembly 3104-R coupled to the elastic substrate loop 3102 and opposite the left pad assembly 3104-L. In one example, the pad has an outer edge having with an outward facing surface that is directly attached to the inner surface of the elastic substrate loop (or fabric layer) to couple the pad assembly to the elastic substrate loop.

Figure 59:
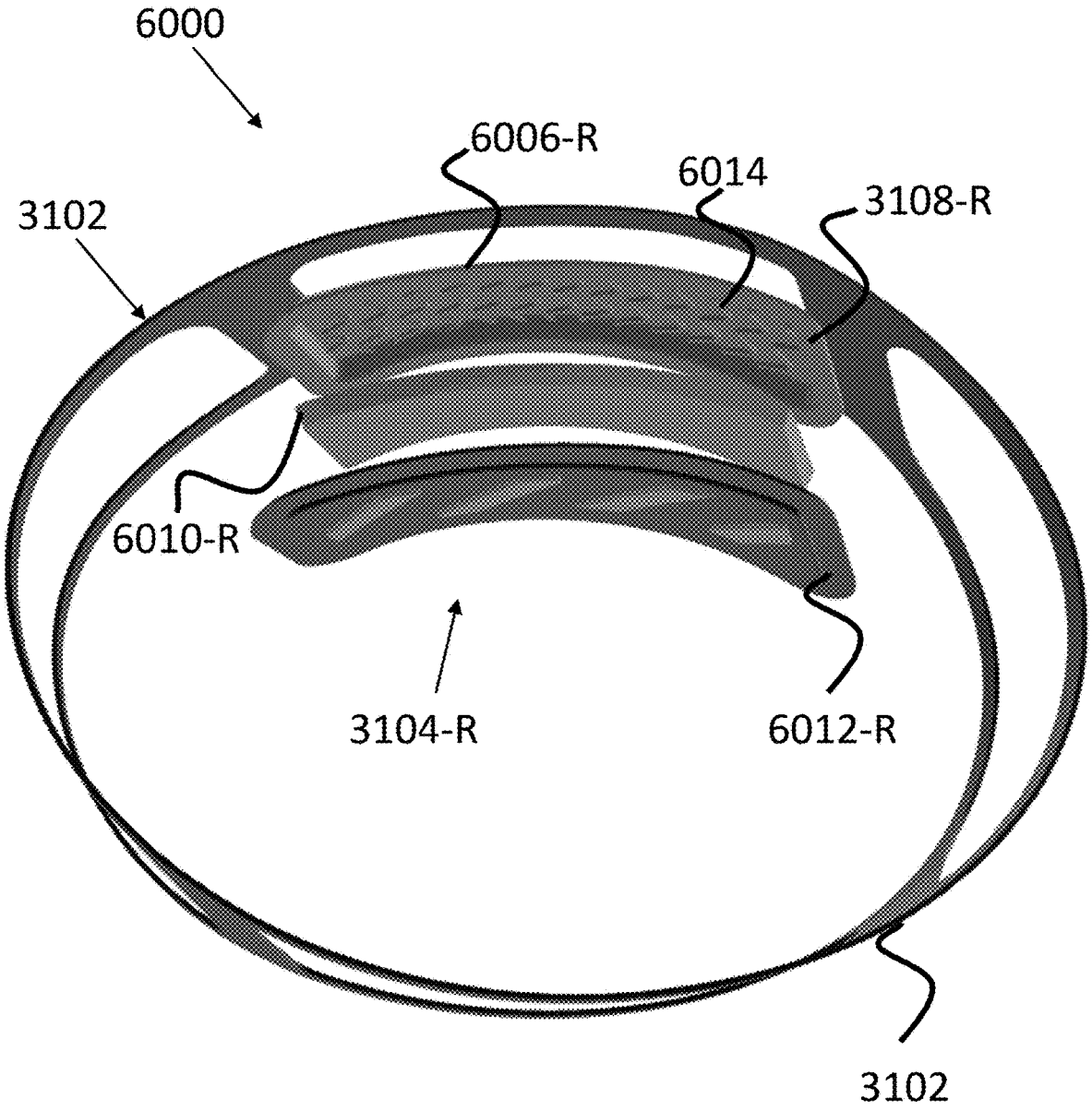
FIG. 59 is a top partial exploded view of the headband shown in FIG. 58.
Figure 60:
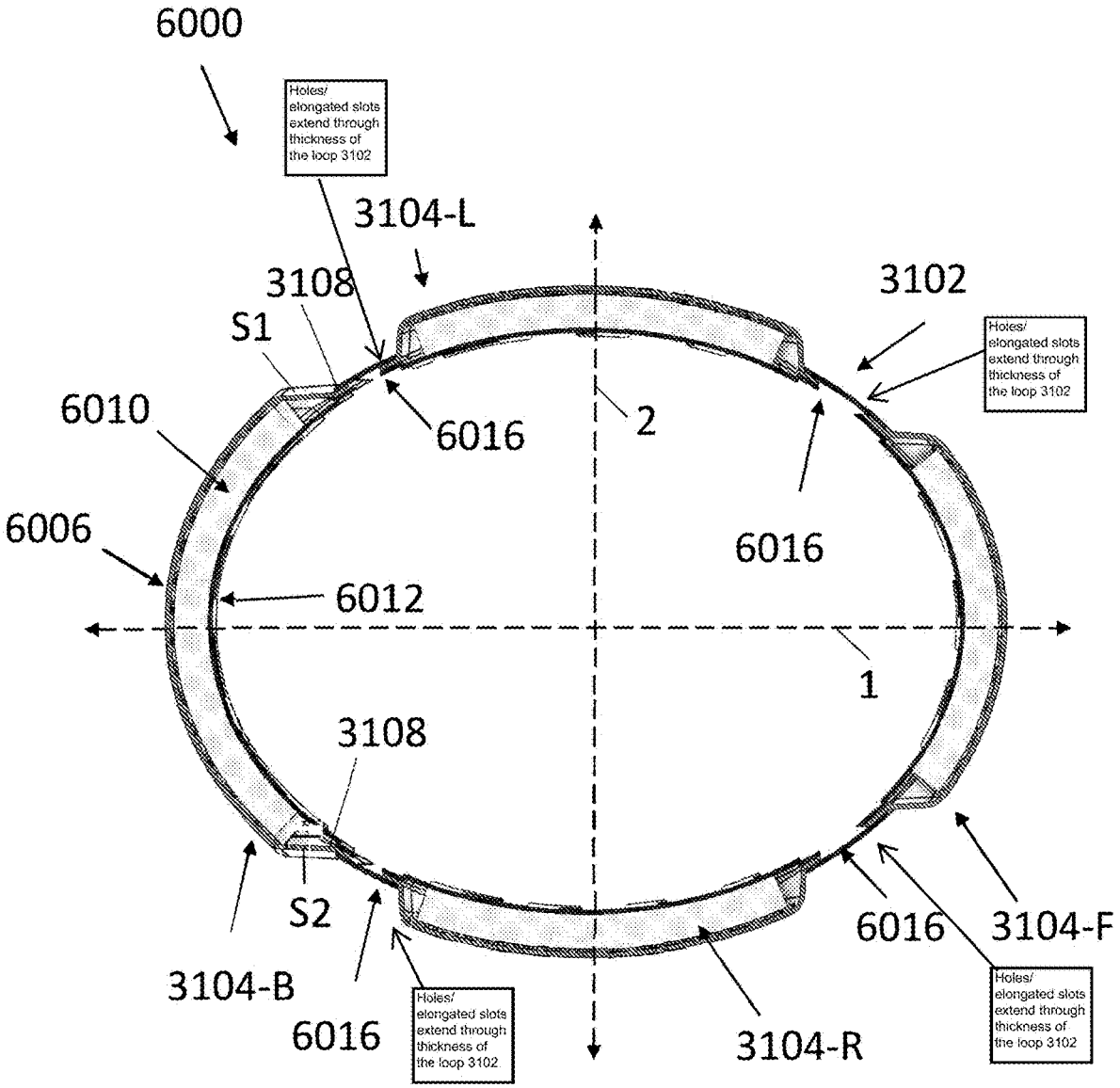
FIG. 60 is a cross-sectional view of the headband shown in FIG. 58, taken along line I-I.
Figure 61:
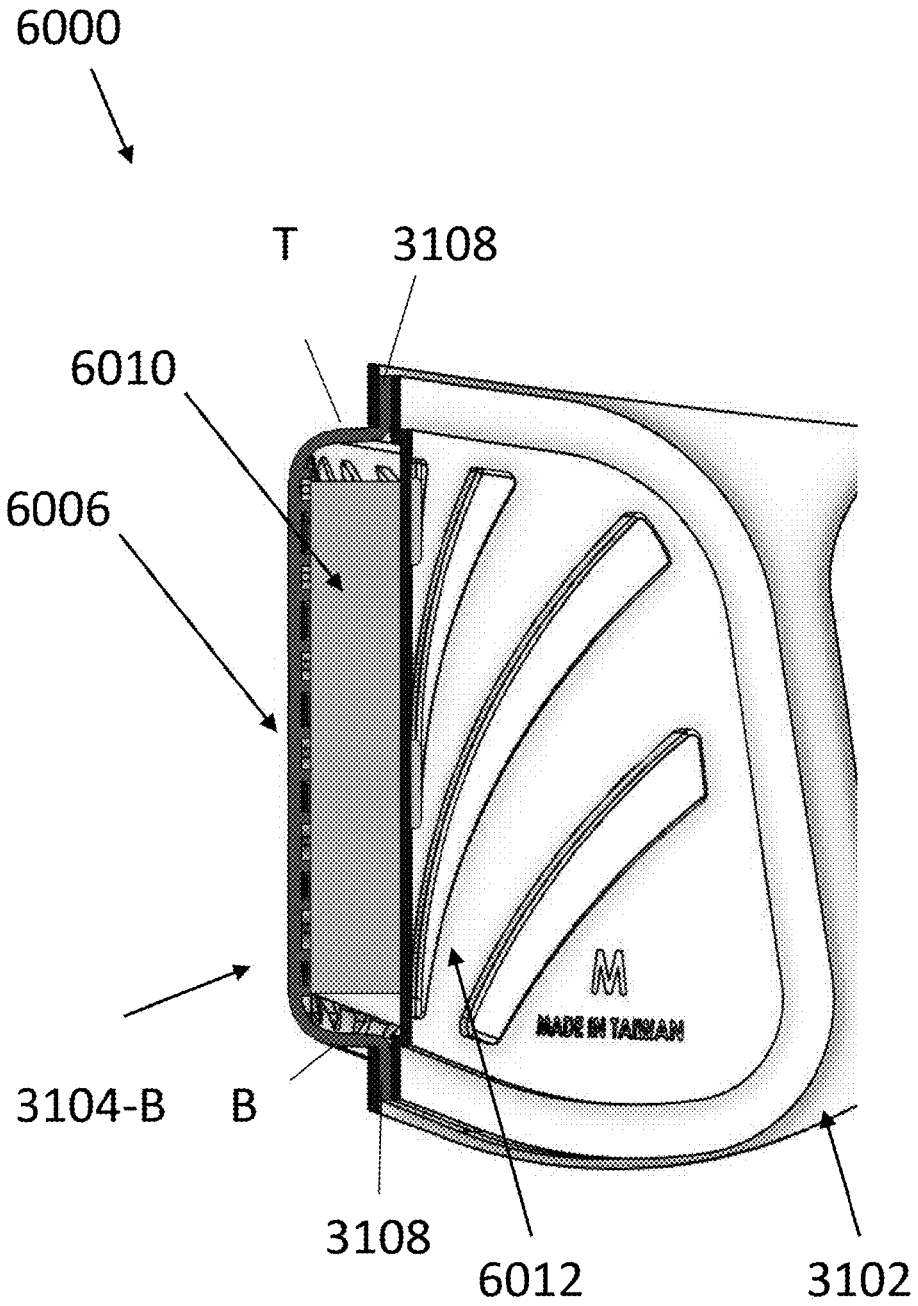
FIG. 61 is a cross-section view of the headband shown in FIG. 58, taken along line II-II.

Referring to FIGS. 58-61, each pad assembly 3104 in the headband 6000 has a top edge T, a bottom edge B (FIG. 61), a first side edge S1, and a second side edge S2 (FIG. 60) opposite the first side edge S1. The first side edge S1 and the second side edge S2 (of each pad assembly) extends from the top edge T to the bottom edge B. The top T, bottom B, first and second side edges S1, and S2 are shown in FIGS. 60 and 61 with respect to the rear pad assembly only for clarity. As discussed above, as shown in FIGS. 60 and 61, the headband 6000 and elastic continuous loop 3102 has a first axis 1 that extends in a front-back direction and a second axis 2 that intersects and is perpendicular to the first axis and extends in a left-right direction. The set of pad assemblies 3104 are positioned so that the first axis 1 intersects a central region located between the first side edge S1 and the second side edge S2 of front and rear pad assemblies 3104-F,3104-B and the second axis 2 intersects a central region located between the first side edge S1 and the second side edge S2 of left and right pad assemblies 3104-L, 3104-R. Details of each component of the pad assembly are further described below. In one example, the outer shell has an outer edge and an outer surface along the outer edge that is directly attached to the inner surface. In some instances no portion of the inner fabric layer or cushion member directly contacts the elastic continuous loop.

The continuous loop 3102 is made of an elastic substrate material and may be referred to the description and claims as a continuous elastic loop. The elastic substrate material is made from sweatband materials, for example one or more of the elastic textile materials that include terry cloth, microfiber, bamboo fabric, polyester fabrics, and polyamide (e.g. nylon). Individual pad assemblies 3104-F, 3104-R, 3104-B, and 3104-L are affixed to the loop 3102 but not directly affixed to each other.

As shown in FIGS. 59-61, each pad assembly 3104 has an inner fabric layer 6012 configured of face the head of the wearer, cushion member 6010 adjacent to the inner fabric layer, a non-porous polymer outer shell 6006 opposite the inner fabric layer 6012, and adjacent to the cushion member 6010. The inner fabric layer 6012 and the non-porous polymer outer shell 6006 encapsulate the cushion member 6010. Because the pad assemblies are coupled to the elastic loop 3102, not directly attached to each other and extends arounds only a portion of the elastic loop 3102, a set of elastic sections 6016 are formed between adjacent pad assemblies 3104. The elastic sections 6016 are configured to provide flexibility to protective headband 6000. In addition, the elastic sections may have holes or slits that extends through the thickness of the loop 3102. The holes or slits are configured to provide additional flexibility to the loop 3102.

As shown in FIGS. 58-61, the inner fabric layer 6012, the non-porous polymer outer shell 6006, and the elastic substrate loop 3102 are bonded together. In one example, the inner fabric layer 6012, the non-porous polymer outer shell 6006, and the elastic substrate loop 3102 are bonded together via RF sealing. In another example, the inner fabric layer 6012, the non-porous polymer outer shell 6006, and the elastic substrate loop 3102 are bonded together via ultrasonic sealing.

The inner fabric layer 6012 may be a textile fabric. Exemplary inner fabric layers include woven or knitted fabrics composed of thermoplastic fibers and yarns. Thermoplastic fibers and yarns may include polyester fibers and/or polyamide fibers. The inner fabric layer 6012 has an outer surface that faces the cushion member 6010 and inner surface that faces the head of the wearer when the headband 6000 is worn. In addition, the inner surface of the inner fabric layer 6012 has a non-porous polymer coating in an intermittent pattern. The pattern may be any particular design element that will generally extend away or project from the inner surface of the fabric layer 6012. The non-porous polymer coating is configured to provide grip and retention to the head of the wearer.

The outer shell 6006 may be a non-porous polymer outer shell. The outer shell, which may be vacuum-formed to form a recess (not numbered), a sidewall, and outer flanges that extends outward from the sidewall. More specifically, the non-porous polymer outer shell has a perimeter and a flange 3108-R, 3108-F, 3108-B, 3108-L that extends around an entirety of the perimeter. Flange 3108 is shown in FIG. 61 for the rear pad assembly 3104-B. As shown in FIGS. 60 and 61, the inner fabric layer 6012 is bonded to one side the flange 3108 and the elastic continuous loop 3102 is bonded to the other side of the flange 3108. In one example, the elastic loop 3102 and flanges 3108 are affixed to one another via RF sealing and/or ultrasonic sealing, as described above.

The non-porous polymer outer shell 6006 of each pad assembly 3104 has an outer surface designed and configured to accept permanent durable graphics and text, e.g. design elements or branding features. In certain embodiments, the non-porous polymer outer shell 6006 may be formed of a translucent material. In addition, the inside surface of the outer shell 6006 may be include an internal structure 6014, such as grooves, ridges, lines, or any particular raised or recessed design element, as shown FIG. 59. When combined with translucent material, the internal structure 6014 is observable through the translucent outer shell. In one example, the front pad assembly has an outer shell that is translucent and an internal structure 6014.

As described above, each pad assembly 3104 includes a cushion member 6010 that can serve to absorb impacts and provides some level of protection from head injury to the wearer. The cushion members 6010 are soft, compressible, resilient, and resistant to tearing. In one example, the cushion members, or pads 6010 include foam material. A closed cell foam, open-cell foam, TPU structure, or latex based foam material may be used as a cushion member. The cushion member 6010 itself is sized and configured to fit in the recess of the outer shell. More specifically, the cushion member has an outer perimeter that is generally smaller than the perimeter of the sidewall of the outer shell. In this way, the cushion member fits in the recess while not interfering with the bonds between the flange of the outer shell, the inner fabric layer, and elastic loop.

In one method of use, the headband 6000 is placed on the wearer's head in a manner similar to a sweatband, such that the front pad assembly 3104-F faces outward from the wearer's forehead, the right pad assembly 3104-R faces outward from the wearer's right temple, the left pad assembly 3104-L faces outward from the wearer's left temple, and the back pad assembly 3104-B faces outward from the back of the wearer's head. Thus, impact force on the wearer's head is reduced from incidental contact, as well as from intentional head use, i.e., heading a soccer ball.

From the foregoing description, those skilled in the art will recognize that a protective helmet assembly has been provided. While the present disclosure has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The present disclosure in its broader aspects is therefore not limited to the specific details, representative apparatus and methods, and illustrative examples shown and described. Accordingly, departures may be made from such details without departing from the spirit or scope of applicant's general inventive concept.

The invention claimed is:

1. A protective headband for a head of a wearer, comprising:

an elastic substrate loop having an outer surface, an inner surface opposite the outer surface, an open top, and an open bottom so that the inner surface is configured to directly contact a portion of the head of the wearer when the protective headband is worn;

a front pad assembly coupled to the elastic substrate loop;

a rear pad assembly coupled to the elastic substrate loop and opposite the front pad assembly;

a left side pad assembly coupled to the elastic substrate loop and positioned between the front pad assembly and the rear pad assembly;

a right side pad assembly coupled to the elastic substrate loop and opposite the left side pad assembly, each pad assembly having a) an outer edge having with an outward facing surface that is directly attached to the inner surface of the elastic substrate loop to couple the pad assembly to the elastic substrate loop, b) an inner fabric layer configured to face the head of the wearer, c) a cushion member adjacent to the inner fabric layer, and d) an outer shell opposite the inner fabric layer defining the outward facing surface, and adjacent to the cushion member, wherein the inner fabric layer and the outer shell encapsulate the cushion member; and elastic sections positioned between adjacent pad assemblies, wherein the elastic sections are configured to provide flexibility to the protective headband.

2. The protective headband according to claim 1, wherein each pad assembly extends around only a portion of the elastic substrate loop.

3. The protective headband according to claim 1, wherein the inner fabric layer, the outer shell, and the elastic substrate loop are bonded together.

4. The protective headband according to claim 3, wherein the inner fabric layer, the outer shell, and the elastic substrate loop are bonded together via RF sealing or ultrasonic sealing.

5. The protective headband according to claim 1, wherein an inner surface of the inner fabric layer has a polymer coating in an intermittent pattern, the polymer coating configured to provide grip and retention to the head of the wearer.

6. The protective headband according to claim 1, wherein the front pad assembly has a texture on the outer shell.

7. The protective headband according to claim 1, wherein the elastic sections have holes configured to provide flexibility.

8. The protective headband according to claim 1, wherein the elastic sections have elongated slots configured to provide additional flexibility.

9. The protective headband according to claim 1, wherein the outer shell of each pad assembly has an outer surface configured to accept permanent durable graphics and text.

10. The protective headband according to claim 1, wherein the outer shell is a translucent material.

11. The protective headband according to claim 10, wherein the outer shell includes an internal structure, wherein the internal structure is observable through the translucent material.

12. The protective headband according to claim 1, wherein the outer shell has a perimeter and flange that extends around the perimeter, and the inner fabric layer is bonded to one side of the flange and the elastic substrate loop is bonded to another side of the flange.

13. A protective headband for a head of a wearer, comprising:

an elastic continuous loop configured to encircle the head of the wearer, the elastic continuous loop configured having an outer surface, an inner surface opposite the outer surface, an open top, and an open bottom so that the inner surface is configured to directly contact a portion of the head of the wearer when the protective headband is worn;

a set of pad assemblies coupled directly to the inner surface of the elastic continuous loop, wherein each pad assembly in the set of pad assemblies is positioned in a spaced apart relation along the elastic continuous loop, each pad assembly having a) an inner fabric layer configured to face the head of the wearer, b) a cushion member adjacent to the inner fabric layer, and c) an outer shell opposite the inner fabric layer, and adjacent to the cushion member, wherein the inner fabric layer and the outer shell encapsulate the cushion member so that the outer shell forms at least part of an outer surface of the protective headband, wherein the outer shell has an outer edge and an outer surface along the outer edge that is directly attached to the inner surface of the continuous elastic loop and no portion of the inner fabric layer or cushion member directly contacts the elastic continuous loop; and elastic sections in spaced relation between adjacent pad assemblies, wherein the elastic sections are configured to provide flexibility to the protective headband.

14. The protective headband according to claim 13, wherein the inner fabric layer, the outer shell, and the elastic substrate loop are attached together.

15. The protective headband according to claim 14, wherein the inner fabric layer, the outer shell, and the elastic substrate loop are bonded together with an RF seal or ultrasonic seal.

16. The protective headband according to claim 13, wherein an inner surface of the inner fabric layer has a polymer coating in an intermittent pattern, the polymer coating configured to provide grip and retention to the head of the wearer.

17. The protective headband according to claim 13, wherein each pad assembly has a texture on the outer shell.

18. The protective headband according to claim 13, wherein the elastic sections have holes configured to provide flexibility.

19. The protective headband according to claim 13, wherein the elastic sections have elongated slots configured to provide additional flexibility.

20. The protective headband according to claim 13, the outer surface is configured to accept permanent durable graphics and text.

21. The protective headband according to claim 13, wherein the outer shell is a translucent material.

22. The protective headband according to claim 21, wherein the outer shell includes an internal structure, wherein the internal structure is observable through the translucent material.

23. The protective headband according to claim 13, wherein the outer shell has a perimeter and a flange that extends around the perimeter, and the inner fabric layer is bonded to one side of the flange and the elastic continuous loop is bonded to another side of the flange.

24. The protective headband according to claim 13, wherein each pad assembly has a top edge, a bottom edge, a first side edge, and a second side edge opposite the first side edge, wherein the first side edge and the second side edge extend from the top edge to the bottom edge, wherein elastic continuous loop has a first axis that extends in a front-back direction and a second axis that intersects and is perpendicular to the first axis and extends in a left-right direction, wherein the set of pad assemblies are four pad assemblies and are positioned so that the first axis intersects a central region located between the first side edge and the second side edge of two pad assemblies and the second axis intersects a central region located between the first side edge and the second side edge of two pad assemblies.

* * * * *